US009008528B2

(12) United States Patent
Kondo

(10) Patent No.: US 9,008,528 B2
(45) Date of Patent: Apr. 14, 2015

(54) INDUCTION HEATING FUSING DEVICE AND IMAGE FORMING APPARATUS

(71) Applicant: Samsung Electronics Co., Ltd., Suwon-si (KR)

(72) Inventor: Takashi Kondo, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 95 days.

(21) Appl. No.: 13/713,532

(22) Filed: Dec. 13, 2012

(65) Prior Publication Data

US 2013/0164013 A1 Jun. 27, 2013

(30) Foreign Application Priority Data

Dec. 13, 2011 (JP) ..... 2011-272302
Dec. 6, 2012 (KR) ..... 10-2012-0141201

(51) Int. Cl.
*G03G 15/20* (2006.01)
*H05B 6/06* (2006.01)
*H05B 6/14* (2006.01)

(52) U.S. Cl.
CPC ..... *G03G 15/2039* (2013.01); *H05B 6/06* (2013.01); *H05B 6/145* (2013.01)

(58) Field of Classification Search
CPC ..... G03G 15/205; G03G 15/2004; G03G 15/2039; H05B 6/06; H05B 6/145
USPC ..... 399/67, 69, 70, 88, 328–330
See application file for complete search history.

(56) References Cited

U.S. PATENT DOCUMENTS

2003/0071034 A1 4/2003 Thompson et al.
2003/0086718 A1* 5/2003 Birumachi ..... 399/67
2007/0071478 A1* 3/2007 Hong ..... 399/88

(Continued)

FOREIGN PATENT DOCUMENTS

EP 0 619 692 4/1994
EP 2 367 071 3/2011
JP 2004-37569 2/2004

(Continued)

OTHER PUBLICATIONS

PCT International Search Report mailed Mar. 29, 2013 in corresponding International Application No. PCT/KR2012/010843.

(Continued)

*Primary Examiner* — Walter L Lindsay, Jr.
*Assistant Examiner* — Jessica L Eley
(74) *Attorney, Agent, or Firm* — Staas & Halsey LLP

(57) ABSTRACT

An induction heating fusing device and an image forming apparatuses that may control even a very small current region by tracking a resonance frequency to perform PWM control and phase control without considering a deviation of a part constant or a temperature change are provided. The induction heating fusing device includes: a serial resonance circuit having an induction coil and a condenser; a phase comparator, a phase controller, a resonance frequency tracking oscillator, and a PWM (pulse width modulation) signal generator. The phase comparator compares a phase of a pulse outputted by the PWM signal generator with a phase of current flowing through the induction coil, outputs a comparison result obtained by the comparing to the phase controller when controlling the phase, and outputs the comparison result to the resonance frequency tracking oscillator when performing PWM control.

10 Claims, 19 Drawing Sheets

(56) References Cited

U.S. PATENT DOCUMENTS

| | | | | |
|---|---|---|---|---|
| 2011/0223533 | A1 | 9/2011 | Ishikawa | |
| 2012/0032718 | A1 * | 2/2012 | Chan et al. | 327/156 |

FOREIGN PATENT DOCUMENTS

| | | |
|---|---|---|
| JP | 2008-51951 | 3/2008 |
| JP | 2008-129582 | 6/2008 |
| JP | 2008-145990 | 6/2008 |
| JP | 2011-186232 | 9/2011 |
| JP | 2012-133028 | 7/2012 |

OTHER PUBLICATIONS

Extended European Search Report issued Sep. 2, 2013 in corresponding European Application No. 12 19 6915.

* cited by examiner

INDUCTION HEATING FUSING DEVICE AND IMAGE FORMING APPARATUS

CROSS-REFERENCE TO RELATED APPLICATIONS

This application claims the benefit of Japanese Patent Application No. 2011-272302, filed on Dec. 13, 2011, in the Japan Patent Office and Korean Patent Application No. 2012-0141201, filed on Dec. 6, 2012, in the Korean Intellectual Property Office, the disclosures of which are incorporated herein in their entirety by reference.

BACKGROUND

1. Field

The present disclosure relates to an induction heating fusing device and an image forming apparatus.

2. Description of the Related Art

An image forming apparatus is provided with a fusing device for fusing a transferred toner image on a recoding medium, such as a sheet. The fusing device includes a fusing roller or a fusing belt (heating roller) thermally fusing a toner transferred on the sheet, and a pressurizing roller pressure-welded to the fusing roller or the fusing belt to pressurize the sheet.

An induction heating fusing device which is provided inside or outside the fusing roller or the fusing belt with an induction heating coil to heat the fusing roller or the fusing belt is widely employed. An induction heating method heats the fusing roller or the fusing belt by allowing a magnetic flux generated by the induction heating coil to flow through a conductor part of the fusing roller or the fusing belt to allow an eddy current to flow through the inside of the fusing belt or the fusing roller and to heat the fusing roller or the fusing belt with Joule heat generated by this eddy current.

Power control methods in a related art induction heating fusing device are classified into a method of controlling a driving frequency with an LCR resonance circuit, and a method of controlling a current amount by performing a PWM control while a resonance circuit is resonated at a resonance frequency f. Related art methods of changing an output power by controlling a driving frequency are disclosed in Japanese Patent Publication Nos. 2008-51951 and 2008-145990.

In a related art induction heating fusing device 900 designed to convert a current amount by performing a PWM control in the state of a resonance frequency f to control a current amount, a construction of an inverter power supply is shown in FIG. 1. A current from an AC power supply 901 is full-wave rectified using diode bridge 904, passes through a noise filter 905, and is supplied to a half bridge output circuit 906. In FIG. 1, reference numerals 902 and 903 indicate a fuse, and a surge voltage protecting varister, respectively.

The half bridge output circuit 906 is a switching element, and includes, for example, an insulated gate bipolar transistor (IGBT), a field effect transistor (FET), etc.

In the construction of FIG. 1, the half bridge output circuit 906 employs IGBTs 907 and 908 as switching elements. An LC serial resonance circuit includes a induction heating low loss coil 912, and condensers 913, 914, and generates a magnetic field while a high frequency current flows through the induction heating low loss coil 912 being composed of a Ritz wire (an electric wire comprised of thin stranded copper wires. The magnetic field generated by the induction heating low loss coil 912 is concentrated on the fusing roller or the fusing belt 910 made of a high permittivity material to allow an eddy current to flow through a surface of a heat radiator, so that the fusing roller or the fusing belt itself generates heat.

A phase comparison between a driving voltage of an output of a current transformer 909 for detecting current and phase difference of the induction heating low loss coil 912 and a driving voltage (one side) of a half bridge output by IGBTs 907 and 908 is performed by a phase comparator 928 (e.g., commonly used PLL IC (74HC4046, etc.)) in a phase-locked loop (PLL) circuit 927, and a phase comparison result of the phase comparator 928, which also receives a current outputted from a limiter circuit 931, is outputted to an RC saw oscillation type voltage control oscillator (VCO) 929. An oscillation frequency of the VCO 929 is feedback-controlled such that the phase difference between the driving voltage of the output of the current transformer 909 and the driving voltage of the output of the half bridge disappears. A resistance 926 is used for allowing current to flow through the resistance 926 from the current transformer 909.

In a PWM controller 919, a PWM On duty value calculated through a proportional, integral, differential (PID) operation by a PID controller 917 at a CPU 915 from information of a heat radiator temperature sensor 911, and an output of the current transformer 909 which has been rectified by a rectifying circuit 930 are amplified by an error amp 920, the amplified value and an output of VCO 929 are compared by a comparator 921, and a comparison result is outputted to a PWM driver 922, and the PWM driver 922 may output a PWM signal to photodiodes and phototransistors 923 and 924. The CPU 915 further includes an AD converter (ADC) 916 and a DA converter (DAC) 918.

In the power control methods of the related art induction heating fusing device that controls a driving frequency by using an LCR resonance circuit, in case a resonance frequency of the resonance circuit is changed, it may be impossible to control the induction heating fusing device, and for cope with such a circumstance, like the invention disclosed in Japanese Patent Publication No. 2008-51951, there is a need to obtain a frequency which allows power to be peaked and to control the obtained frequency as a lower limit frequency. Also, in controlling a small power, the frequency is so high that a switching loss of the half bridge output element may be increased and thus efficiency may be reduced. As a solution, there is a need to divide the power control method into a large power control method, a middle power control method, and a small power control method. Also, when the half bridge element is switched in a state that a driving frequency deviates from the resonance frequency, a zero voltage switching is not performed, so that a device loss may be generated, and degeneration or heat fracture due to heat generation may be caused.

Meanwhile, in the methods that change the current amount by performing a PWM control in a state that a resonance circuit is resonated at a frequency of f to control the current amount, since a phase comparator, a voltage control generator and a PWM controller are configured by an analog circuit, there is a need to consider a deviation in component constant or variation in temperature, or to change component constant according to the specification, like setting of a resonance frequency tracking range. Also, in case there is a frequency region (e.g., a specific RF or a resonance frequency of a fusing device, such as a fusing belt) that may not be used for a specific purpose, it is difficult to deviate from such a frequency range and automatically track the resonance frequency.

Further, by performing only the PWM control, a very small current region may not be controlled. This is because the switching speed of a switching element, for example, an IGBT is not fast to such a degree that may control a very small current by using a PWM.

SUMMARY

Additional aspects and/or advantages will be set forth in part in the description which follows and, in part, will be apparent from the description, or may be learned by practice of the invention.

The present disclosure provides an induction heating fusing device and an image forming apparatus that may control even a very small current region by tracking a resonance frequency to perform PWM control and phase control without considering a deviation of a part constant or a temperature change.

According to an aspect of the present disclosure, there is provided an induction heating fusing device including: a serial resonance circuit having an induction coil and a condenser; a phase comparator, a phase controller, a resonance frequency tracking oscillator, and a PWM (pulse width modulation) signal generator, wherein the phase comparator compares a phase of a pulse outputted by the PWM signal generator with a phase of current flowing through the induction coil, outputs a comparison result obtained by the comparing to the phase controller when controlling the phase, and outputs the comparison result to the resonance frequency tracking oscillator when performing PWM control, the phase controller outputs a frequency control signal which has a predetermined phase value based on an output of the phase controller and a predetermined coil current phase amount, the resonance frequency tracking oscillator changes an oscillation frequency by using an output of the phase controller such that a driving frequency of the serial resonance circuit tracks the resonance frequency, the PWM signal generator generating a pulse to drive the serial resonance circuit based on the resonance frequency by the resonance frequency tracking oscillator, and the phase comparator, the phase controller, the resonance frequency tracking oscillator, and the PWM signal generator are digitally controlled.

The phase controller counts at a counter thereof an output of the phase comparator which compares the phase of the pulse outputted by the PWM signal generator with the phase of current flowing through the induction coil to output a signal corresponding to the phase difference, compares and operates a set value of phase amount of coil current by using a subtractor, and outputs a frequency control signal to the resonance frequency tracking oscillator, and the resonance frequency tracking oscillator moves up or down the counter based on a signal outputted by the phase controller to change the oscillation frequency.

The phase control may be performed in a first region through which a relatively small current flows, and the PWM control may be performed in a second region through which a relatively large current flows.

According to another aspect of the present disclosure, there is provided an image forming apparatus including the above induction heating fusing device.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
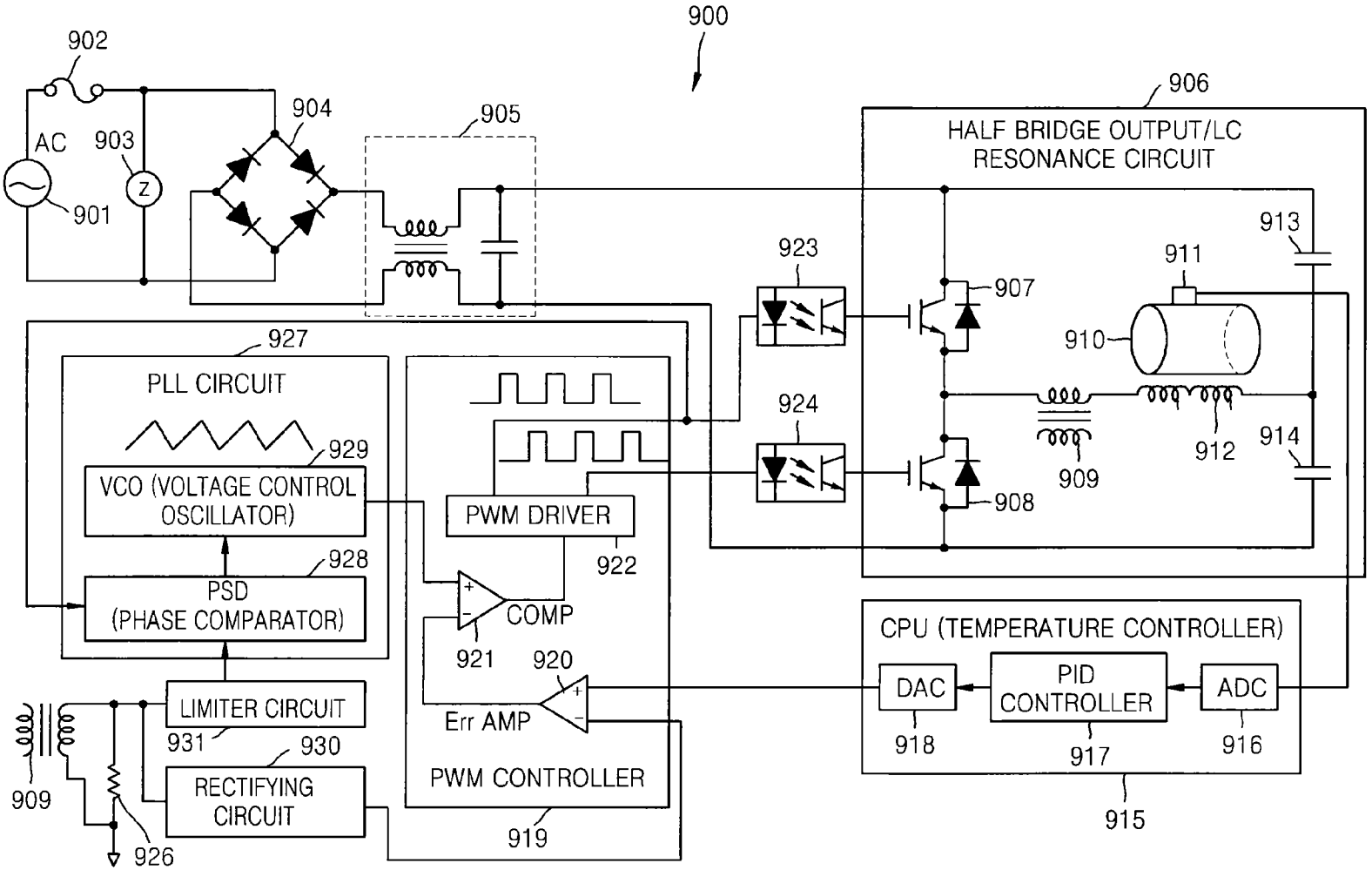
FIG. 1 (PRIOR ART)
FIG. 1 is a circuit diagram showing a construction of an inverter power supply of a related art induction heating fusing device.

The present disclosure will now be described more fully with reference to the accompanying drawings, in which exemplary embodiments of the present disclosure are shown. Like reference numerals in the description and drawings denote like elements. Elements having the common subordinate two digits in reference numerals correspond to each other.

Exemplary Embodiment

Figure 2:
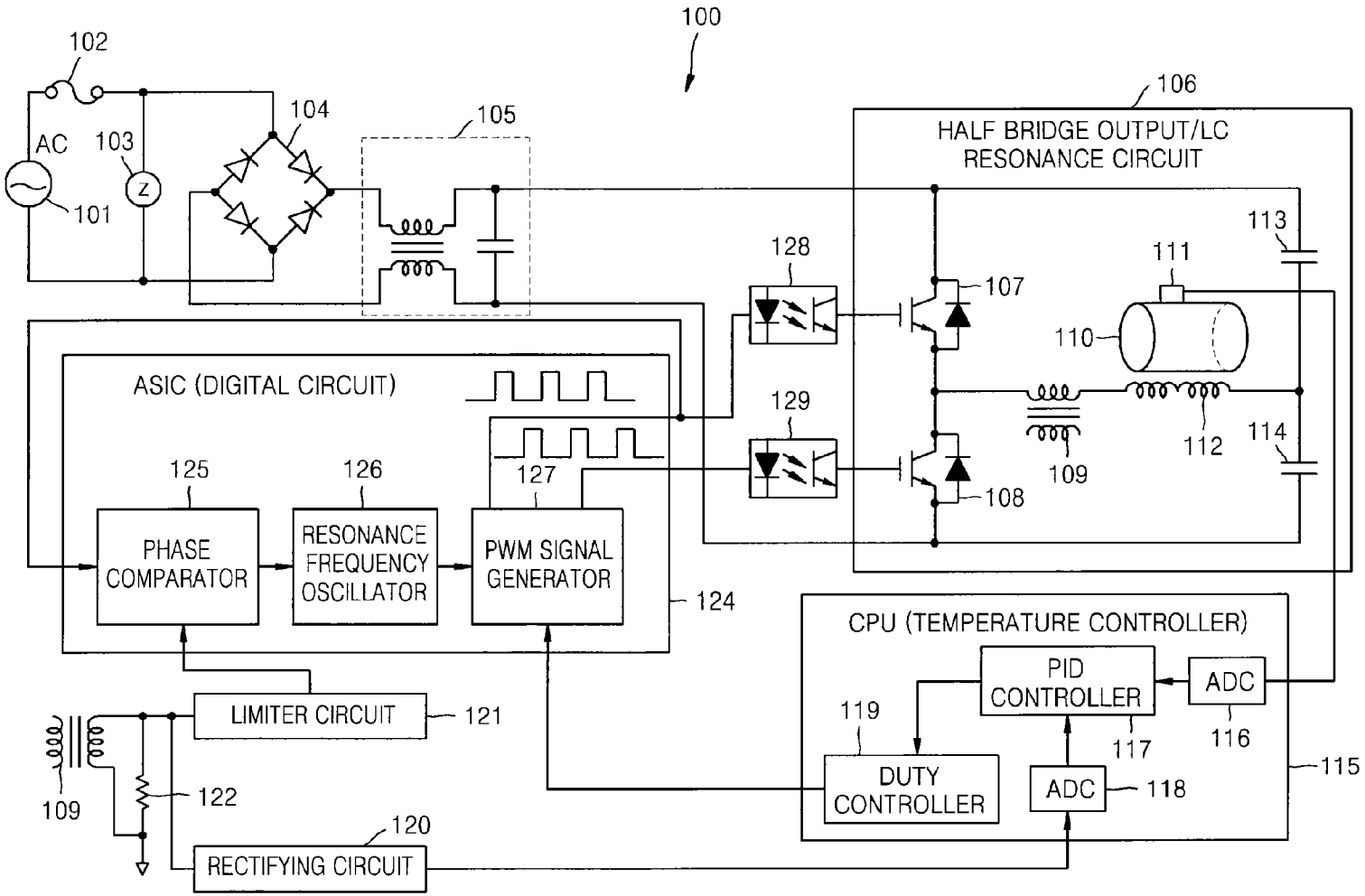
FIG. 2 is a circuit diagram showing a construction of an induction heating fusing device according to an exemplary embodiment of the present disclosure.

First, the construction of an induction heating fusing device according to an exemplary embodiment of the present disclosure will be described. FIG. 2 is a circuit diagram showing a construction of an induction heating fusing device 100 according to an exemplary embodiment of the present disclosure. Hereinafter, the induction heating fusing device 100 according to an exemplary embodiment of the present disclosure will be described with reference to FIG. 2.

The induction heating fusing device shown in FIG. 2 is an induction heating type fusing device provided with an induction heating coil inside or outside a fusing roller or a fusing belt in order to heat the fusing roller or the fusing belt.

As shown in FIG. 2, the induction heating fusing device 100 includes an alternating current (AC) power supply 101, a fuse 102, a varistor 103, a diode bridge 104, a noise filter 105, a half bridge output circuit 106, a central processing unit (CPU) 115, a rectifying circuit 120, a limiter circuit 121, and an application specific integrated circuit (ASIC) 124. An AC current from the AC power supply 101 is full-wave rectified, passes through the noise filter 105, and is supplied to the half bridge output circuit 106.

The induction heating fusing device 100 of FIG. 2 performs a PWM control in a resonance state automatically tracking a resonance frequency to change an output power. That is, by performing a PWM control in a resonance state automatically tracking a resonance frequency, the amount of current is controlled to thus change the amount of current.

The half bridge output circuit 106 includes IBGTs 107 and 108, a current transformer 109, an induction heating low loss coil 112, condensers 113 and 114. The induction heating low loss coil 112 and the condensers 113 and 114 constitute an LC resonance circuit.

The half bridge output circuit 106 uses an insulated gate bipolar transistor (IGBT), a field effect transistor (FET), or the like as a switching element.

In the construction of FIG. 2, the half bridge output circuit 106 uses IGBTs 107 and 108 as switching elements. The LC serial resonance circuit is comprised of the induction heating low loss coil 112, and the condensers 113, 114, and generates a magnetic field while a high frequency current flows through the induction heating low loss coil 112 being composed of a Ritz line (an electric wire comprised of thin stranded copper lines). The magnetic field generated by the induction heating low loss coil 112 is concentrated on a fusing roller or the fusing belt 110 made of a high permittivity material to allow an Eddy current to flow through a surface of a heat radiator, so that the fusing roller or the fusing belt 110 generates heat itself.

The CPU 115 measures a temperature of the fusing roller or the fusing belt 110 and controls a duty of a PWM signal generated by the PWM signal generator 127 to be described later, based on the temperature of the fusing roller or the fusing belt 110 made of a high permittivity material, and includes AD converters (ADC) 116 and 118, a PID controller 117, and a PWM duty controller 119.

The ASIC 124 is used for generating a PWM signal tracking the resonance frequency of the LC resonance circuit comprised of the induction heating low loss coil 112 and the condensers 113 and 114, and includes a phase comparator 125, a resonance frequency tracking oscillator 126, and a PWM signal generator 127. In this embodiment, the construction for generating a PWM signal tracking the resonance frequency of the LC resonance circuit is designed in a digital circuit, so that all elements including the CPU 115 may be installed inside the ASIC (SOC).

The phase comparator 125 detects a phase difference between one of two PWM signals generated by the PWM signal generator 127 and a current outputted from a limiter circuit 121, i.e., a current which is detected by the current transformer 109 and flows through the induction heating low loss coil 112. That is, the phase comparator 125 compares phases between an output of the current transformer 109 for detecting the current and phase difference of the induction heating low loss coil 112 connected to the half bridge output by the IGBTs 107 and 108, and a driving voltage (one side) of the half bridge output by the IGBTs 107 and 108, and outputs a phase comparison result to the resonance frequency tracking oscillator 126.

The resonance frequency tracking oscillator 126 performs a process of tracking an oscillation frequency of the PWM signal generated by the PWM signal generator 127 to the resonance frequency of the LC resonance circuit by using the phase difference detection result. Specifically, the resonance frequency tracking oscillator 126 changes the oscillation frequency of the PWM signal according to the output of the phase comparator 125. For example, the resonance frequency tracking oscillator 126 moves up or down a counter value based on the phase comparison result to control the driving frequency such that the phase difference is zero (resonance frequency).

The PWM signal generator 127 generates a PWM signal by using the oscillation frequency varying based on the process of tracking the oscillation frequency to the resonance frequency of the LC resonance circuit, and outputs the PWM signal to photo diodes and photo transistors 128 and 129. In other words, the PWM signal generator 127 may output to the photodiodes 128 and phototransistors 129 the PWM signal having the PWM On duty value calculated by a proportional integral differential (PID) operation by the PID controller 117 within the CPU 115 from information obtained by the temperature sensor 111 sensing the temperature of the heat radiator.

The rectifying circuit 120 rectifies the output of the current transformer 109. The rectifying circuit 120 rectifies the output of the current transformer 109 and outputs the rectified output to the AD converter 118 of the CPU 115. The limiter circuit 121 limits the output voltage of the current transformer 109 within a predetermined range. The limiter circuit 121 limits the output voltage of the current transformer 109 within a predetermined range, and outputs the limited output voltage to the phase comparator 125 of the ASIC 124. A resistance 122 is used for allowing current to flow through the resistance 122 from the current transformer 109.

The induction heating fusing device 100 shown in FIG. 2 full-wave rectifies an AC current from the AC power supply 101 in the diode bridge 104, allows the full-wave rectified current to pass through the noise filter 105, and then supplies the same to the half bridge output circuit 106.

In the half bridge output circuit 106, as the IBGTs 107 and 108 are alternately switched on and off to operate the current transformer 109, so that the current that has passed through the noise filter 105 flows through the induction heating low loss coil 112. By allowing a high frequency current to flow through the induction heating low loss coil 112, a magnetic field may be generated from the induction heating low loss coil 112. The magnetic field generated by the induction heating low loss coil 112 is concentrated on the fusing roller or the fusing belt 110 made of a high permittivity material. The magnetic field generated by the induction heating low loss coil 112 allows an eddy current to flow through a surface of the heat radiator, thus generating heat from the heat radiator.

Next, an LC resonance principle of the induction heating fusing device 100 shown in FIG. 2 according to an exemplary embodiment of the present disclosure will be described. In an LCR serial resonance circuit including a resistance element of LC, an impedance Z of the LCR serial resonance circuit is obtained by Equation 1 below.

Equation 1

$$Z = R + sL + \frac{1}{sC} = R + j\omega L + \frac{1}{j\omega C} = R + j\left(\omega L - \frac{1}{\omega C}\right)$$

$$Z = R + jX$$

$$X = \left(\omega L - \frac{1}{\omega C}\right)$$

where if a frequency at X=0 is $\omega_0$, a serial resonance frequency $f_0$ is obtained by Equation 2 below.

Equation 2

$$\omega_0 L = \frac{1}{\omega_0 C}$$

$$\omega_0 = \frac{1}{\sqrt{LC}}$$

$$f_0 = \frac{1}{2\pi\sqrt{LC}}$$

Next, when the impedance Z of the LCR serial resonance circuit is expressed by a complex vector, the impedance Z, absolute value |Z|, and phase α are obtained by Equation 3 below.

Equation 3

$$Z = R + jX = |Z|\cos\alpha + j|Z|\sin\alpha = |Z|(\cos\alpha + j\sin\alpha) = |Z|\varepsilon^{j\alpha}$$

$$|Z| = \sqrt{R^2 + X^2} = \sqrt{R^2 + \left(\omega L - \frac{1}{\omega C}\right)^2}$$

$$\alpha = \tan^{-1}\left(\frac{X}{R}\right) = \tan^{-1}\left(\frac{\omega L - \frac{1}{\omega C}}{R}\right)$$

That is, the absolute value |Z| of the impedance becomes a minimum value because the inductance and capacitance are removed at the resonance frequency $f_0$ and only the resistance element is taken.

Meanwhile, when a voltage source V is connected to the serial resonance circuit, a flowing current I, an absolute value |I| of the current, and phase ϕ are obtained by Equation 4 below.

Equation 4

$$I = \frac{V}{Z} = \frac{V}{|Z|\varepsilon^{j\alpha}} = \frac{V\varepsilon^{-j\alpha}}{|Z|}$$

$$I = |I|\varepsilon^{j\phi}$$

-continued $$|I| = \frac{V}{|Z|} = \frac{V}{\sqrt{R^2 + \left(\omega L - \frac{1}{\omega C}\right)^2}}$$

$$\phi = -\alpha = -\tan^{-1}\left(\frac{X}{R}\right) = -\tan^{-1}\left(\frac{\omega L - \frac{1}{\omega C}}{R}\right)$$

From Equation 4, it may be seen that in case the LCR serial resonance circuit is driven by changing voltage, current I at the resonance frequency of $f_0$ takes a maximum value, and current I and voltage V have the same phase. In the above, the LC resonance principle of the induction heating fusing device 100 shown in FIG. 2 has been described.

Figure 4:
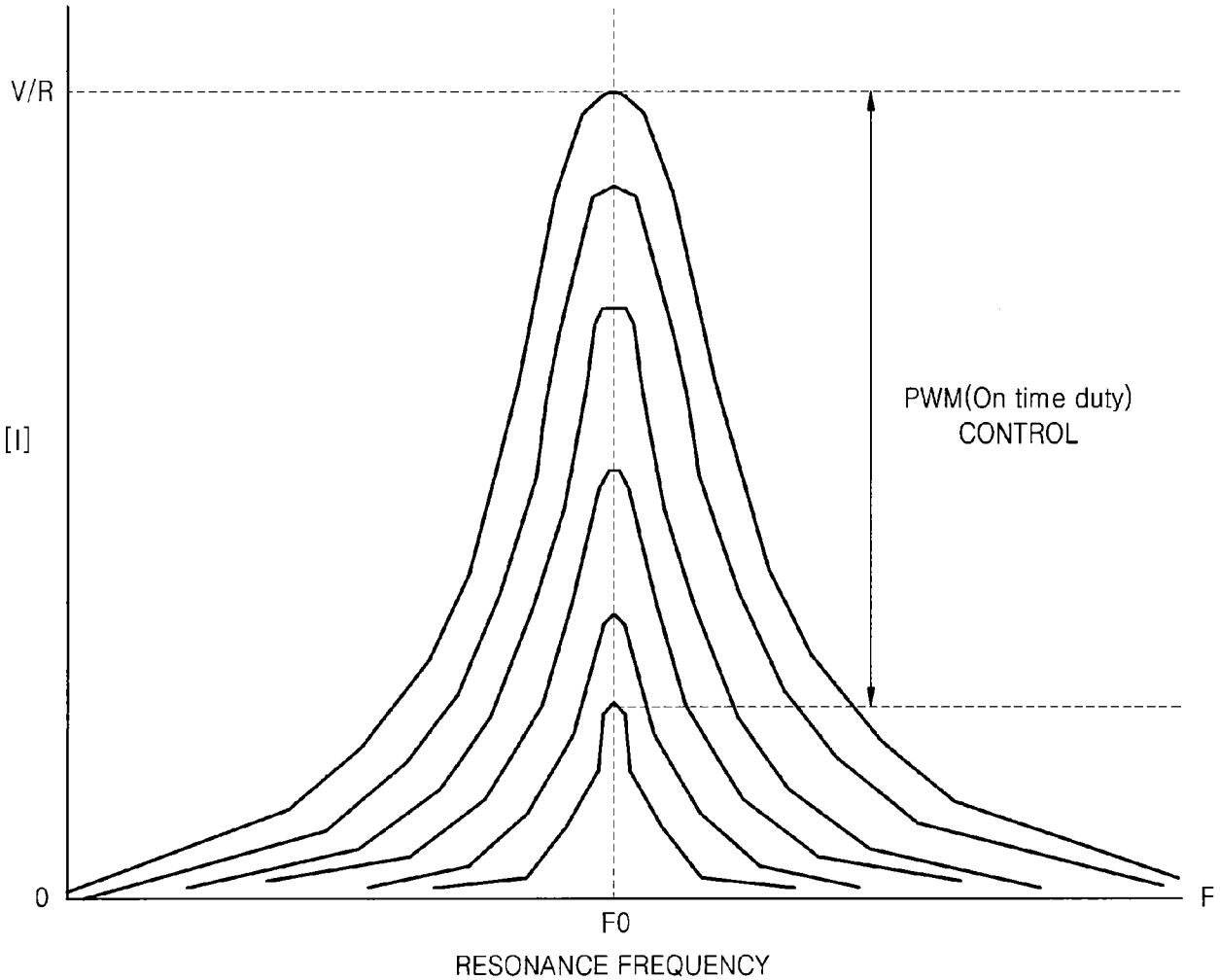
FIG. 4 is a graph showing an output characteristic when On time duty of PWM is changed.

FIG. 4 is a graph showing a current output characteristic of the LCR serial resonance circuit when On time duty (time period of High) of the PWM signal is changed. The current value (absolute value) varies with a reference point of the resonance frequency $f_0$, and the current value (absolute value) also varies by changing On time duty of the PWM signal. That is, when On time of the PWM signal generated by the PWM signal generator 127 is increased, On times of the IGBTs 107 and 108 are increased too, and the current value of the LCR serial resonance circuit is also increased.

In the above, the construction of the induction heating fusing device 100 has been described with reference to FIG. 2. Next, elements constituting the ASIC 124 shown in FIG. 2 will be described in more detail. First, the phase comparator 125 will be described.

Figure 5:
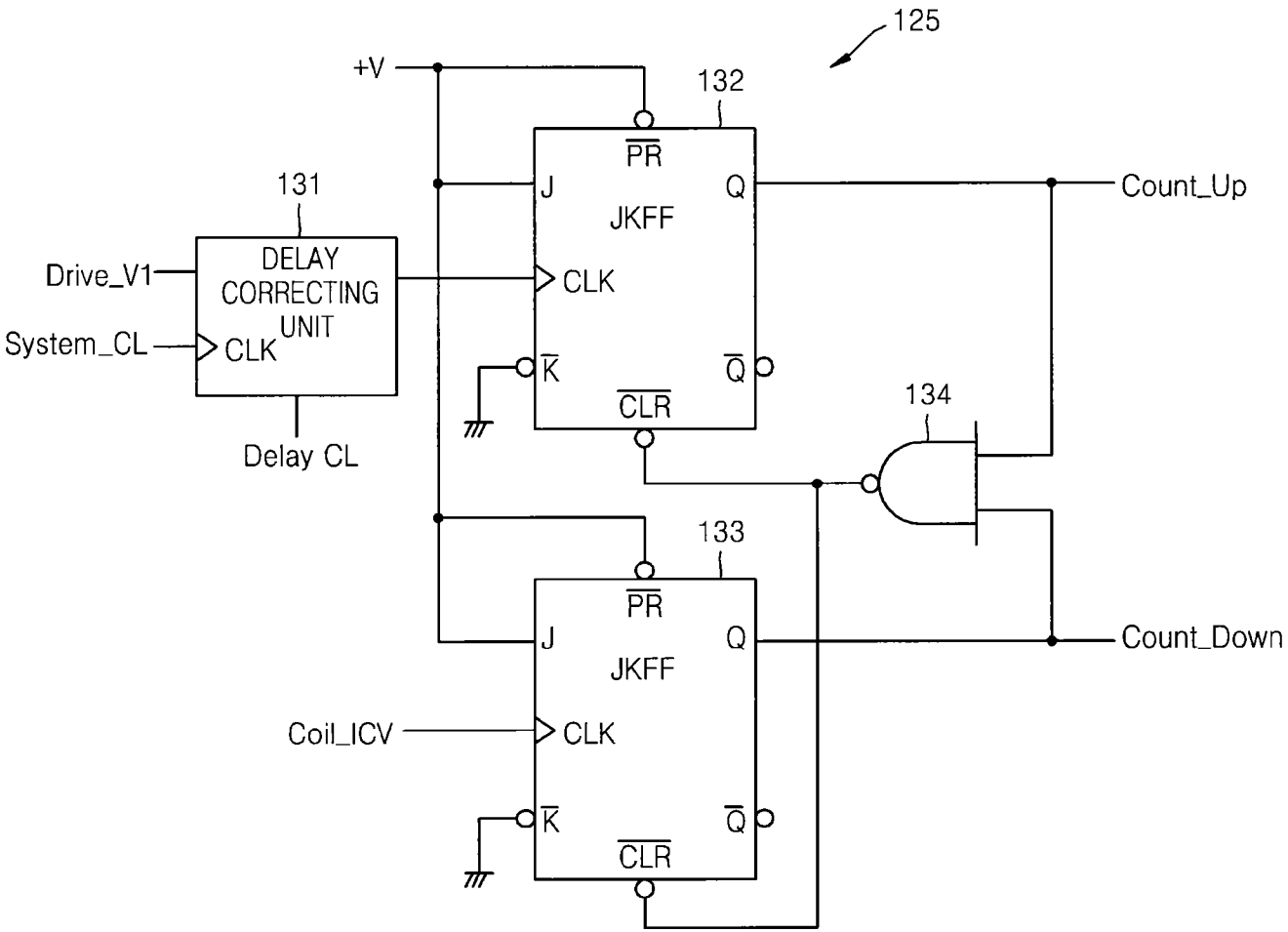
FIG. 5 is a circuit diagram showing a construction of a phase comparator in ASIC.

FIG. 5 is a circuit diagram of the phase comparator 125 in the ASIC 124 shown in FIG. 2. Hereinafter, the phase comparator 125 will be described with reference to FIG. 5.

As shown in FIG. 5, the phase comparator 125 includes a delay correcting unit 131, JK flip flops (JKFF) 132 and 133, and a NAND gate 134.

The delay correcting unit 131 sets a delay correction value of a coil current phase comparison voltage Coil_ICV that makes delay to a drive voltage Drive_V1 generated by the PWM signal generator 127. The drive voltage Drive_V1, a system clock System_CL and a delay clock Delay_CL are inputted into the delay correction unit 131, and the delay correction unit 131 outputs a clock to the JKFF 132. The coil current phase comparison voltage Coil_ICV outputted from the limiter circuit 121 is supplied to the JKFF 133.

Each of the JKFFs 132 and 133 synchronizes states corresponding to a combination of states of input terminals J and K with the inputted clock, and outputs the synchronized states to an output terminal Q and an inversion output terminal. The JKFF 132 outputs a value of 1 (High) when the phase of current flowing through the induction heating low loss coil 112 is lagged with respect to the drive voltage Drive_V1 generated by the PWM signal generator 127. As a result, Count_Up becomes High. Meanwhile, the JKFF 133 outputs a value of 1 (High) when the phase of current flowing through the induction heating low loss coil 112 is led with respect to the drive voltage Drive_V1 generated by the PWM signal generator 127. As a result, Count_Down becomes High.

By configuring the phase comparator 125 as shown in FIG. 5, when a coil current phase comparison voltage Coil_ICV outputted from the limiter circuit 121 is lagged with respect to the drive voltage Drive_V1, Count_Up becomes High, and when the coil current is led, Count_Down becomes High.

Figure 6:
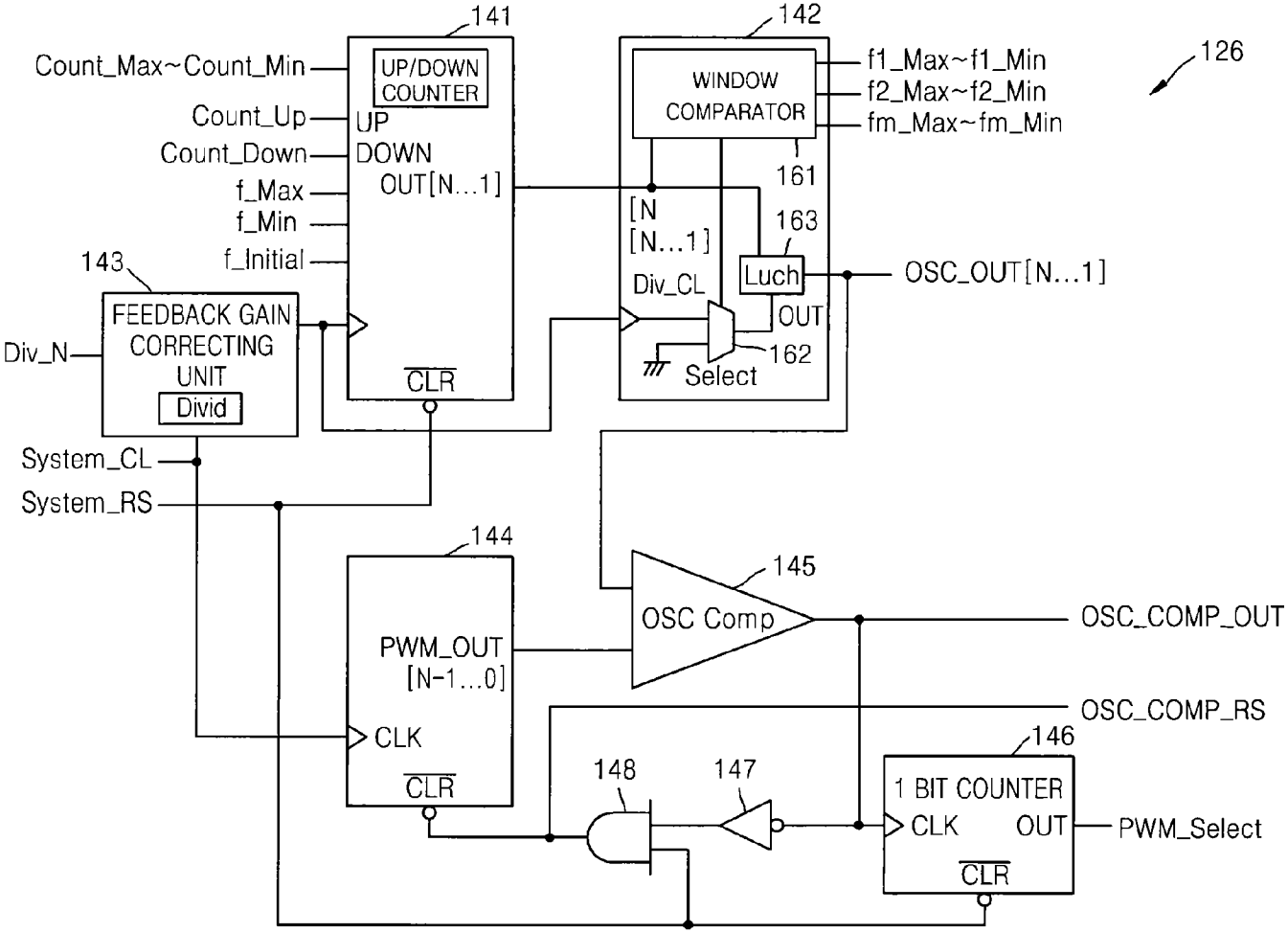
FIG. 6 is a circuit diagram showing a construction of a tracking oscillator in ASIC.

Next, the resonance frequency tracking oscillator 126 will be described. FIG. 6 is a circuit diagram of the resonance frequency tracking oscillator 126 in the ASIC 124 shown in FIG. 2. Hereinafter, the resonance frequency tracking oscillator 126 will be described with reference to FIG. 6.

As shown in FIG. 6, the resonance frequency tracking oscillator 126 includes an up/down counter 141, a frequency comparator 142, a feedback gain correcting unit 143, a PWM counter 144, an OSC comparator 145, a 1 bit counter 146, a NOT gate 147, and an AND gate 148.

The up/down counter 141 receives an output Count_Up or Count_Down of the phase comparator 125 and other parameters, counts up to increase the oscillation frequency while Count_Up in the outputs of phase comparator 125 is High, and counts down to lower the oscillation frequency while Counter_Down is High.

Other input parameters of the up/down counter 141 may include a value (see FIG. 3) of Count_Max-Count_Min that is a range of a value OSC_OUT [N . . . 1] outputted by the frequency comparator 142, an f_Min that is a frequency corresponding to Count_Max, an f_Max that is a frequency corresponding to Count_Min, and an initial set resonance frequency f_initial.

Compared with communication apparatuses requiring strict performances, since the induction heating fusing device does not require a jitter performance of the resonance frequency tracking characteristics as much, it is possible to use the up/down counter 141 having a simple construction so as to track the resonance frequency of the LCR serial resonance circuit.

The frequency comparator 142 performs a comparison between the oscillation frequency and a frequency region (e.g., a specific radio frequency, or a resonance frequency for use in a fusing tool, such as the fusing roller or the fusing belt 110) that is impossible to use for a specific purpose. As shown in FIG. 6, the frequency comparator 142 includes a window comparator 161, a comparison circuit 162, and a latch circuit 163.

The window comparator 161 compares a frequency region (f1_Max to f1_Min, f2_Max to f2_Min, . . . fm_Max to fm_Min) that is impossible to use for a specific purpose, and an output count value of the up/down counter 141. The window comparator 161 outputs High when the output count value of the up/down counter 141 corresponds to the frequency region that is impossible for use for a specific purpose.

Figure 3:
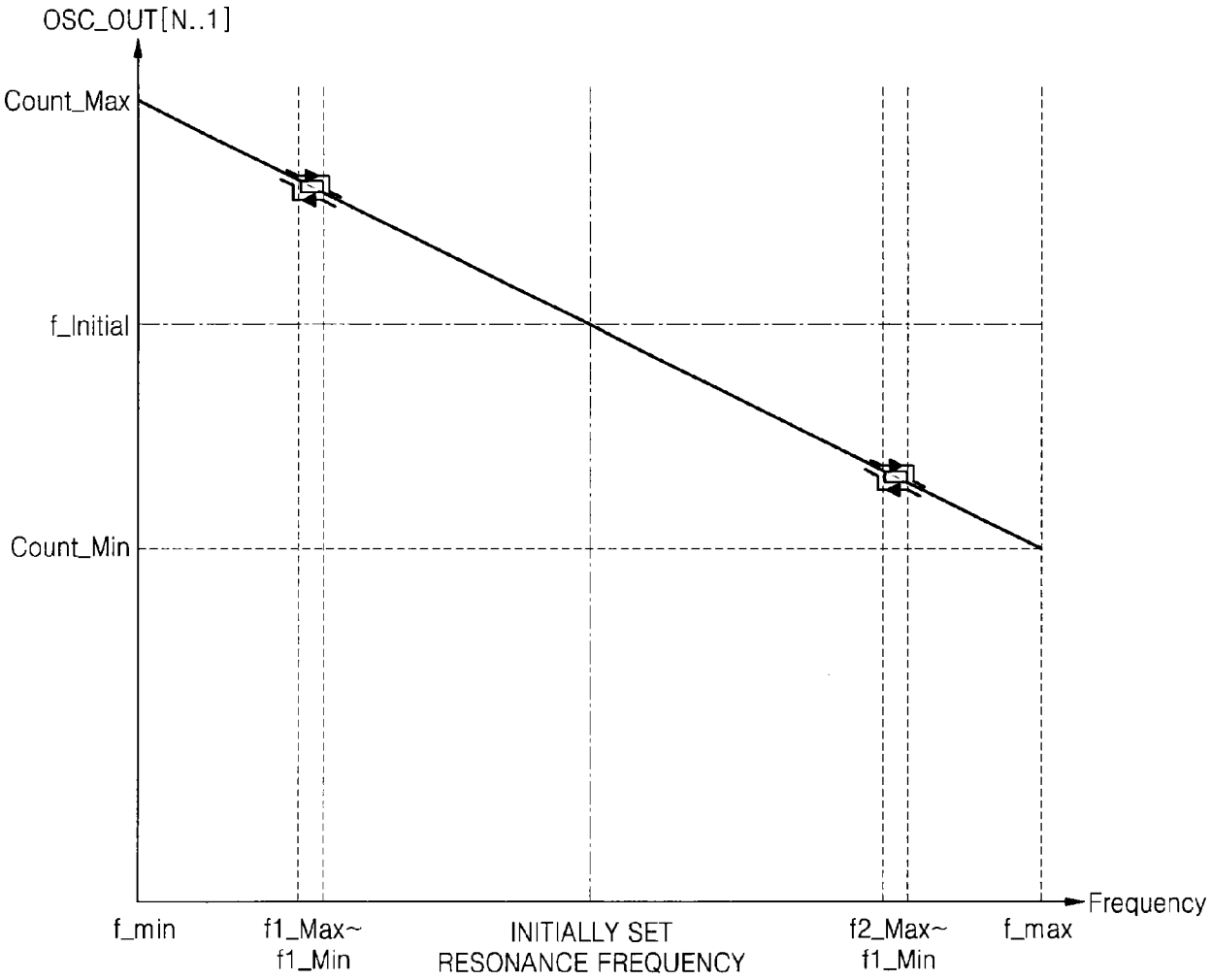
FIG. 3 is a graph showing a relationship between a count value of an up/down counter and an output frequency when a frequency region unavailable for a specific purpose is set.

FIG. 3 is a graph showing a relationship between the counter value of the up/down counter 141 and an output frequency when the frequency region unavailable for a specific purpose is set. In the graph of FIG. 3, a horizontal axis indicates a frequency, and a vertical axis indicates an output FOUT [N . . . 1] of the up/down counter 141. f_Initial corresponds to the initial set resonance frequency $f_0$, Count_Max corresponds to the lower limit frequency f_Min, and Count_Max corresponds to the upper limit frequency f_Max. Thus, the frequency is proportional to the count value of the up/down counter 141.

When the output value FOUT [N . . . 1] of the up/down counter 141 is inputted into the unavailable frequency region, the latch circuit 163 latches a previous frequency value and thus the output frequency is not included in the unavailable frequency region, and the output value FOUT [N . . . 1] of the up/down counter 141 is changed. When the output value FOUT [N . . . 1] of the up/down counter 141 deviates from the unavailable frequency region, the output OSC_OUT [N . . . 1] of the latch circuit 163 becomes an output frequency at a time deviating from the unavailable frequency region.

The PWM counter 144 outputs a counter value PWM_OUT [N−1 . . . 0] based on a system clock System_CL. The OSC comparator 145 compares the output OSC_OUT [N . . . 1] of the frequency comparator 142 and the output PWM_OUT[N−1 . . . 0] of the PWM counter 144 and outputs a comparison result (OSC_COMP_OUT). When the output OSC_OUT [N . . . 1] of the frequency comparator 142 coincides with the output PWM_OUT [N−1 . . . 0] of the PWM counter 144 in the comparison, the OSC comparator 145 changes an output thereof from Low to High for a predetermined time period, and notifies to the PWM signal generator 127 that one period of the resonance frequency is completed.

Figure 7:
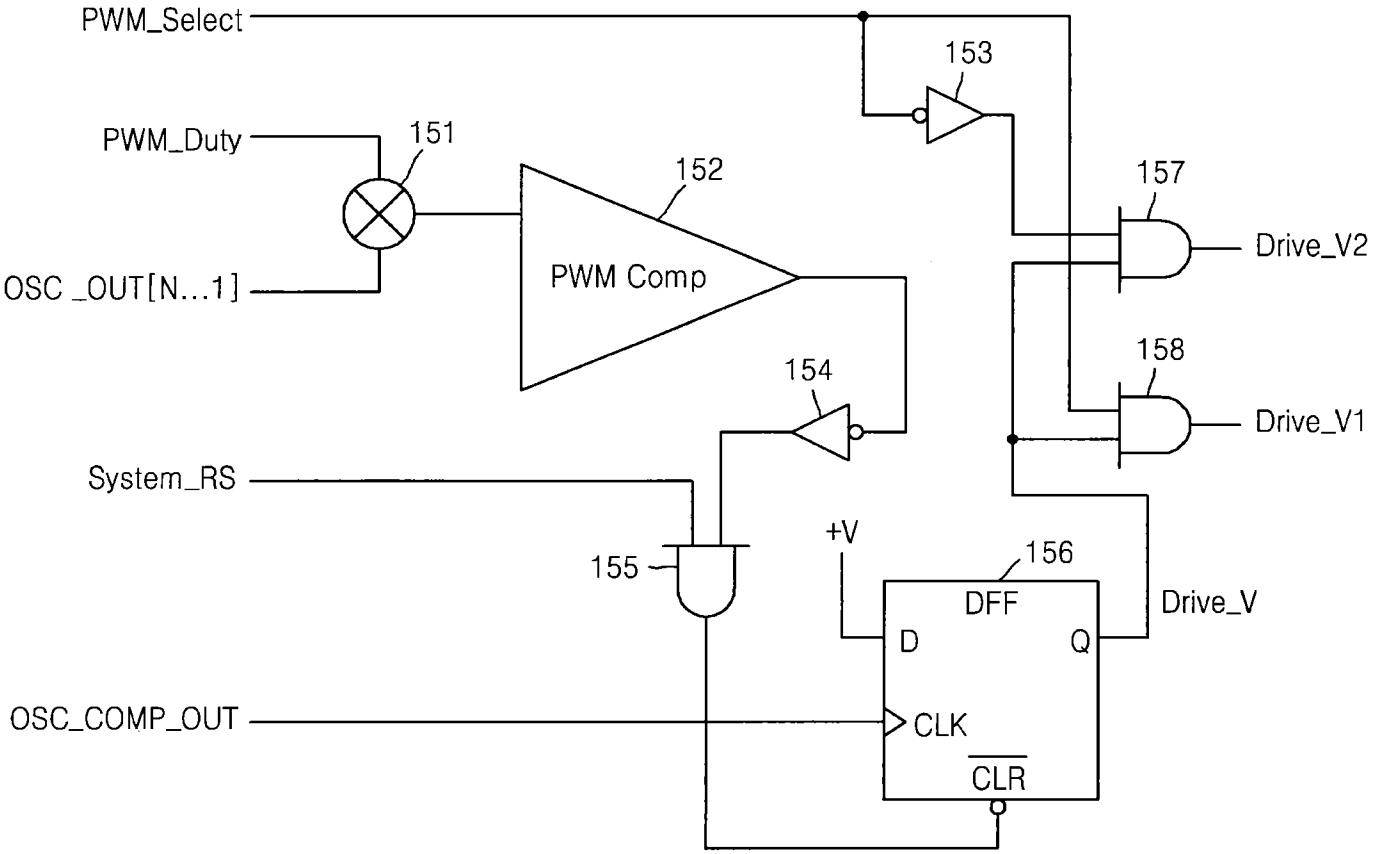
FIG. 7 is a circuit diagram showing a construction of a PWM signal generator in ASIC shown in FIG. 2.

Next, the PWM signal generator 127 will be described. FIG. 7 is a circuit diagram of the PWM signal generator 127 in the ASIC 124 shown in FIG. 2. Hereinafter, the PWM signal generator 127 will be described with reference to FIG. 7.

As shown in FIG. 7, the PWM signal generator 127 includes a multiplier 151, a PWM comparator 152, NOT gates 153 and 154, AND gates 155, 157, and 158, and a D flip flop (DFF) 156.

The PWM comparator 152 compares a result obtained by multiplying information PWM_Duty on duty transmitted from the PWM duty controller 119 and the output OSC_OUT [N . . . 1]) of the frequency comparator 142 at the multiplier 151 with the output PWM_OUT [N−1 . . . 0] of the PWM counter 144, and outputs a comparison result to the NOT gate 154.

The DFF 156 receives the output OSC_COMP_OUT of the OSC comparator 145 and outputs a voltage Drive_V acting as a basis of drive voltages Drive_V1 and Drive_V2. The DFF 156 outputs the Drive_V to the AND gates 157 and 158. The AND gates 157 and 158 respectively output the drive voltages Drive_V1 and Drive_V2 by using an output signal PWM_Select of the 1 bit counter 146.

That is, the PWM signal generator 127 outputs the voltage Drive_V functioning as a basis of the drive voltages Drive_V1 and Drive_V2 that become High by a predetermined period at a timing that OSC_COMP_OUT becomes High. This predetermined period is instructed by the PWM duty controller 119, and the information corresponds to PWM_Duty supplied to the PWM comparator 152.

By configuring the PWM signal generator 127 as shown in FIG. 7, a PWM timing is calculated from On Duty time operated by the CPU 115 and the output count value of the up/down counter 141, the calculated PWM timing is compared with the output value PWM_OUT [N−1 . . . 0] of the PWM counter 144 which is a reset counter by the DFF 156, if the calculated PWM timing coincides with the output value PWM_OUT [N−1 . . . 0] of the PWM counter 144, set the voltage Drive_V functioning as a basis of the drive voltages Drive_V1 and Drive_V2 Low. By doing so, the drive voltages Drive_V1 and Drive_V2 that become High during the On Duty time period are generated, the photodiodes become High during the High period, the phototransistors are turned ON, and thus the IGBTs 107 and 108 are turned on, so that current flows through the LC serial resonance circuit.

Figure 8:
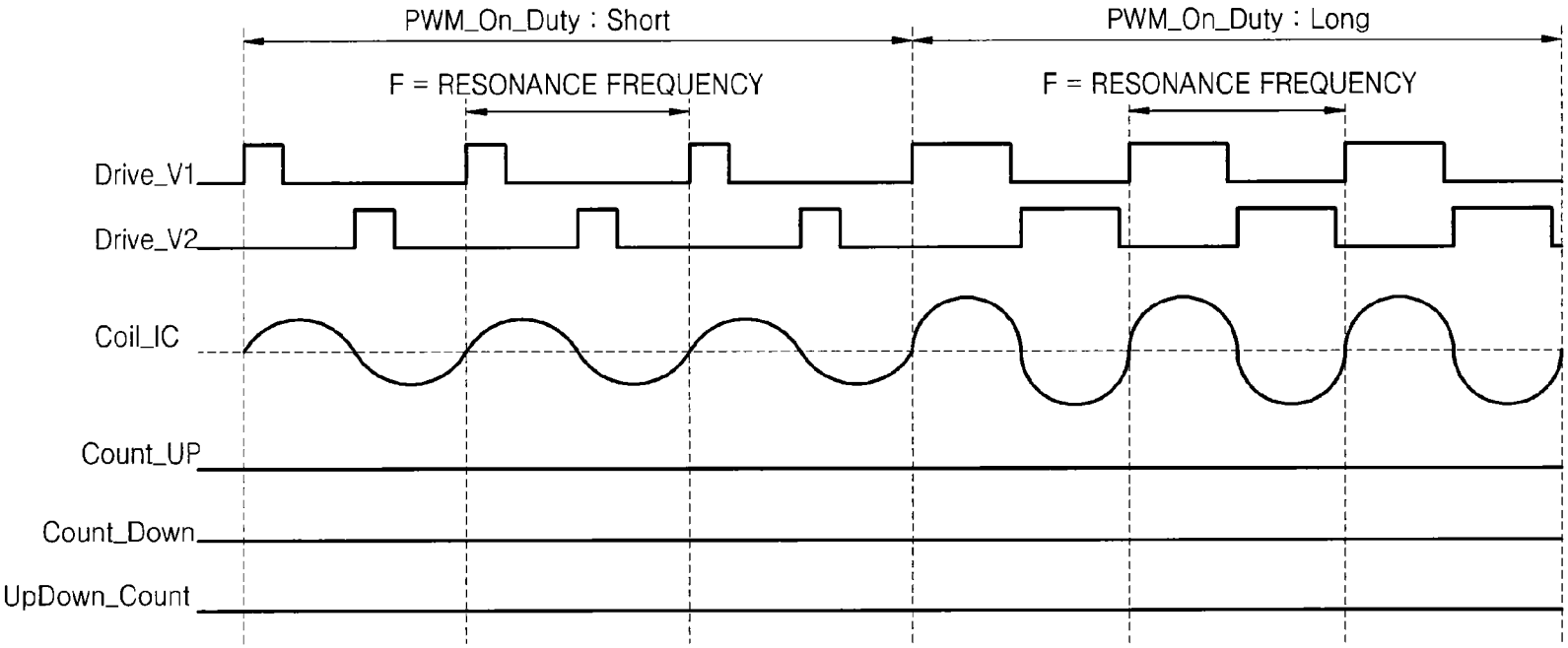
FIG. 8 is a diagram showing operation waveforms of a resonance frequency tracking oscillator.
Figure 9:
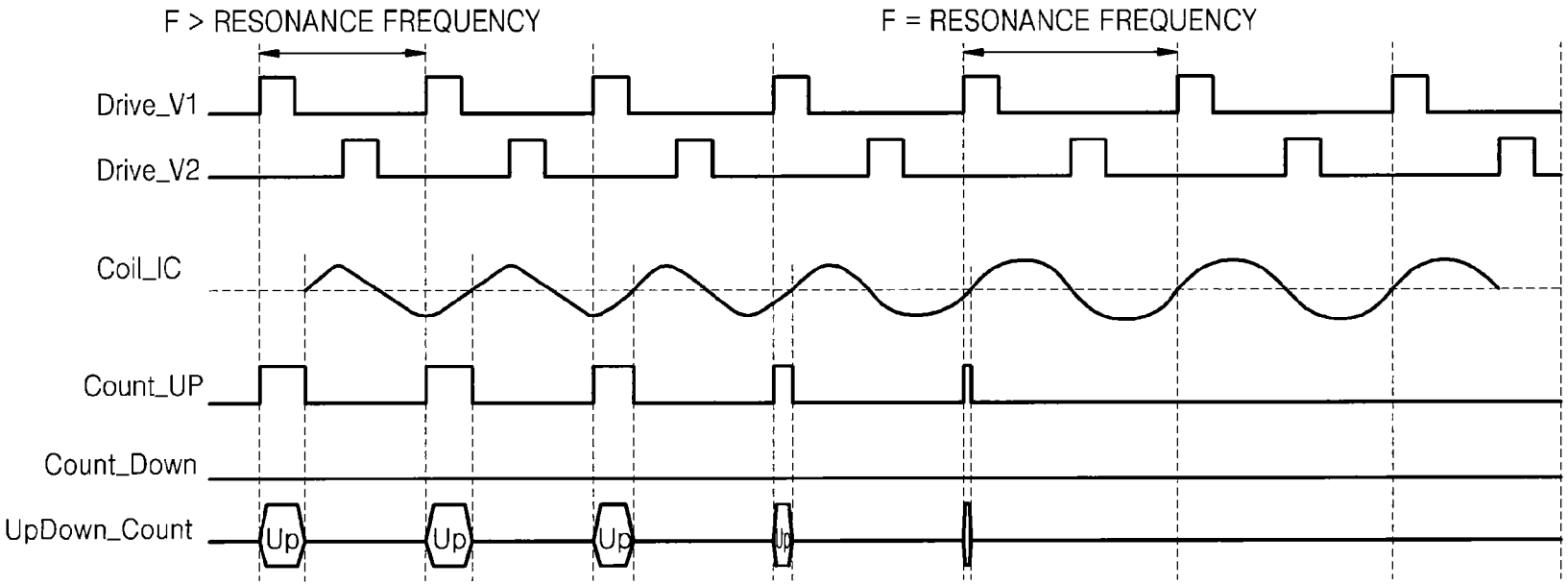
FIG. 9 is a diagram showing operation waveforms of a resonance frequency tracking oscillator.
Figure 10:
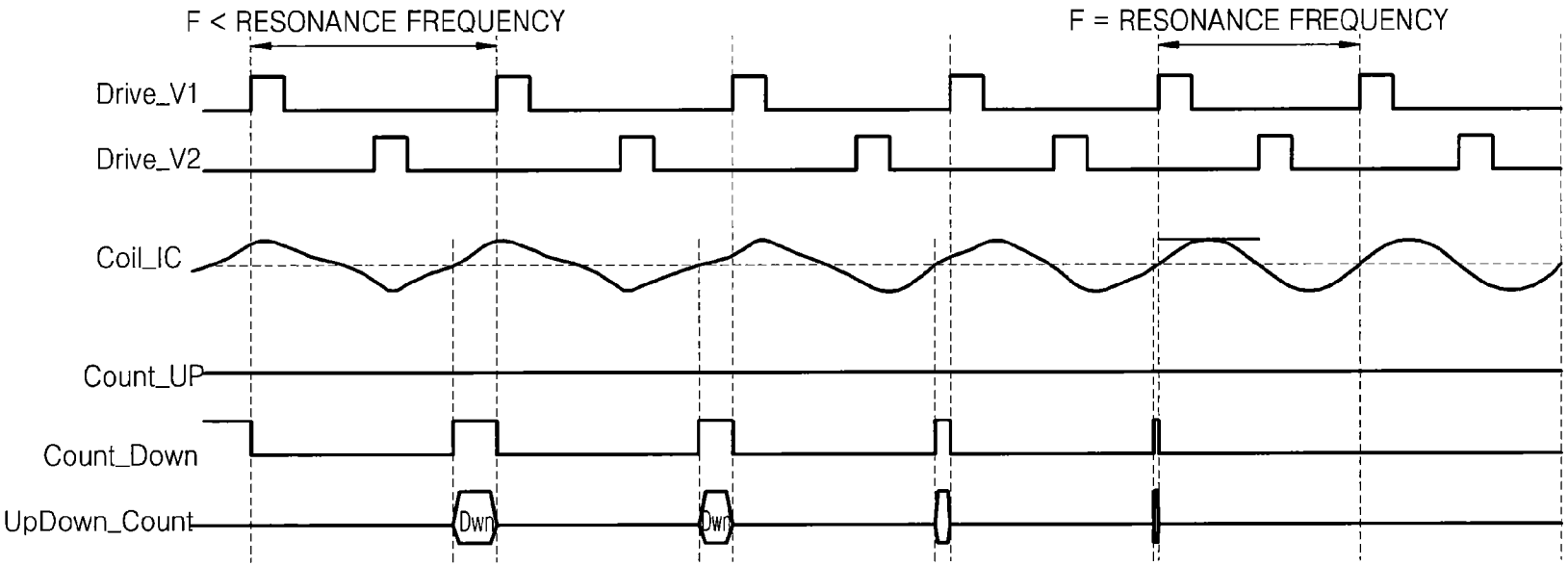
FIG. 10 is a diagram showing operation waveforms of a resonance frequency tracking oscillator.

In the above, the phase comparator 125, the resonance frequency tracking oscillator 126, and the PWM signal generator 127 have been described. Next, an operation of the resonance frequency tracking oscillator 126 will be described. FIGS. 8 to 10 show operation waveforms of the resonance frequency tracking oscillator 126.

FIG. 8 shows an operation waveform of the resonance frequency tracking oscillator 126 when the operating frequency of the drive voltages Drive_V1 and Drive_V2 and the resonance frequency coincide with each other. Also, FIG. 9 shows an operation waveform of the resonance frequency tracking oscillator 126 when the operating frequency of the drive voltages exceeds the resonance frequency. FIG. 10 shows an operation waveform of the resonance frequency tracking oscillator 126 when the operating frequency of the drive voltages is less than the resonance frequency.

FIG. 8 shows that a peak value of the current flowing through the coil varies depending on the length of the On Duty of the drive voltages Drive_V1 and Drive_V2. The length of the On Duty of the drive voltages Drive_V1 and Drive_V2 varies depending on the control of the PWM duty controller 119.

In FIG. 8, since the operating frequency of the drive voltages coincides with the resonance frequency, the output Count_Up or Count_Down of the phase comparator 125 is always Low, and thus the output UpDown_count of the up/down counter 141 is not generated.

FIGS. 9 and 10 show that a phase difference is detected from the operation waveform of the coil current and the drive voltage and a feedback control is performed by increasing or decreasing the output of the up/down counter 141 such that the operating frequency becomes the resonance frequency.

First, when the operating frequency of the drive voltages exceeds the resonance frequency, an operation of the resonance frequency tracking oscillator 126 will be described with reference to FIG. 9. When the operating frequency of the drive voltages exceeds the resonance frequency, the phase of the current flowing through the coil is lagged with the drive voltages, Count_Up among the outputs of the phase comparator 125 becomes High. The period that Count_Up is High is a period during which after the drive voltage Drive_V1 is converted from Low to High, the phase of the coil current becomes 0.

When Count_Up among the outputs of the phase comparator 125 becomes High, the up/down counter 141 counts up during the High period and then outputs increased count value. By doing so, it becomes possible to track the operating frequency of the drive voltage to the resonance frequency.

Meanwhile, when the operating frequency of the drive voltages is less than the resonance frequency, an operation of the resonance frequency tracking oscillator 126 will be described with reference to FIG. 10. When the operating frequency of the drive voltages is less than the resonance frequency, the phase of the current flowing through the coil is led with the drive voltages, Count_Down among the outputs of the phase comparator 125 becomes High. The period that Count_Down is High is a period during which after the phase of the coil current becomes 0, the drive voltage Drive_V1 is converted from Low to High.

When Count_Down among the outputs of the phase comparator 125 becomes High, the up/down counter 141 counts down during the High period and then outputs decreased count value. By doing so, it becomes possible to track the operating frequency of the drive voltages Drive-V1 and Drive_V2 to the resonance frequency.

Figure 11:
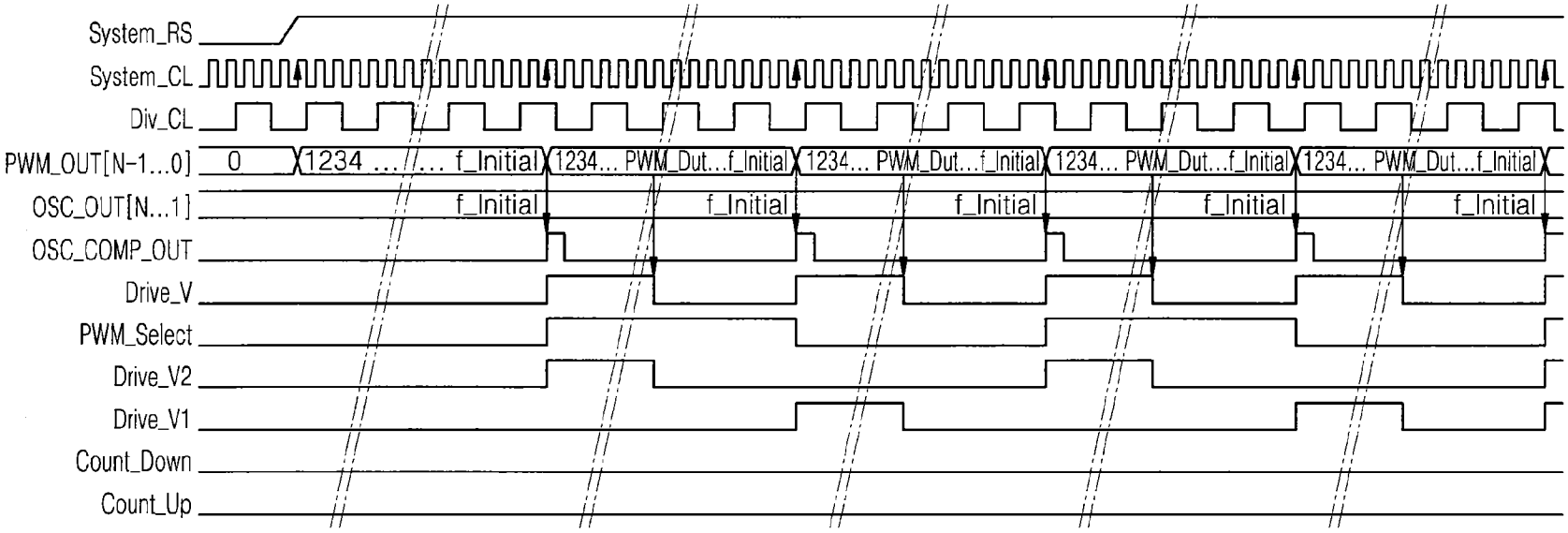
FIG. 11 is a timing chart showing output details of a resonance frequency tracking oscillator and a PWM signal generator.
Figure 12:
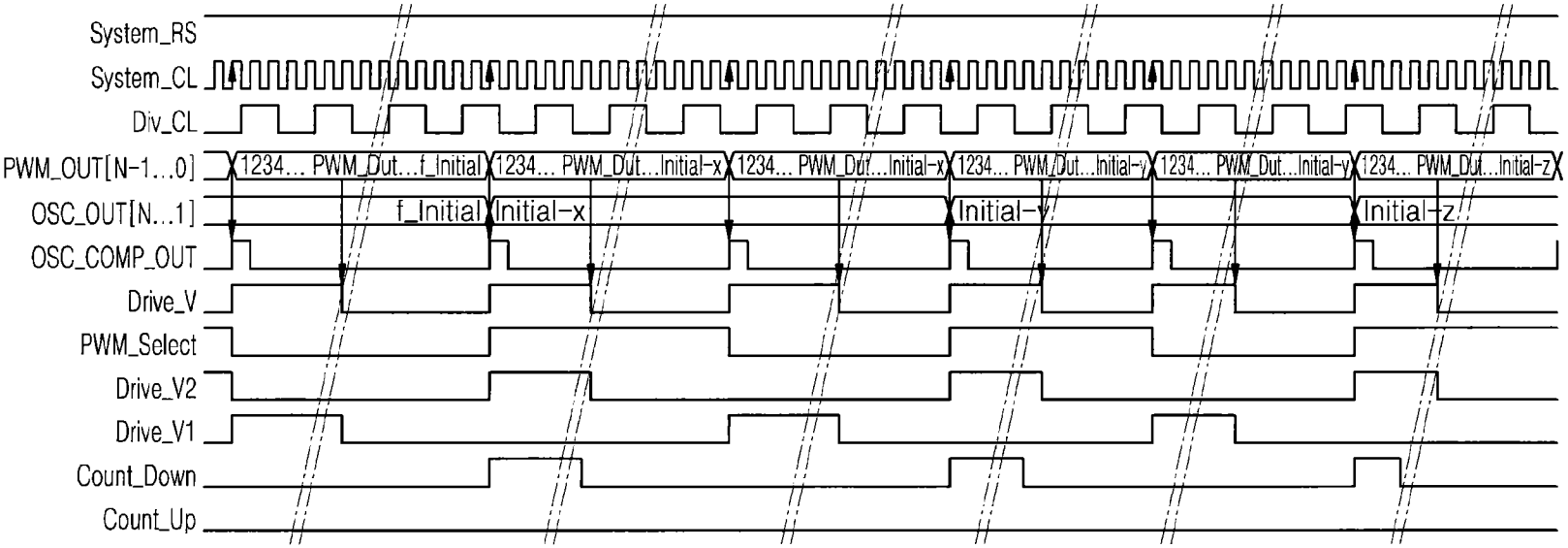
FIG. 12 is a timing chart showing output details of a resonance frequency tracking oscillator and a PWM signal generator.
Figure 13:
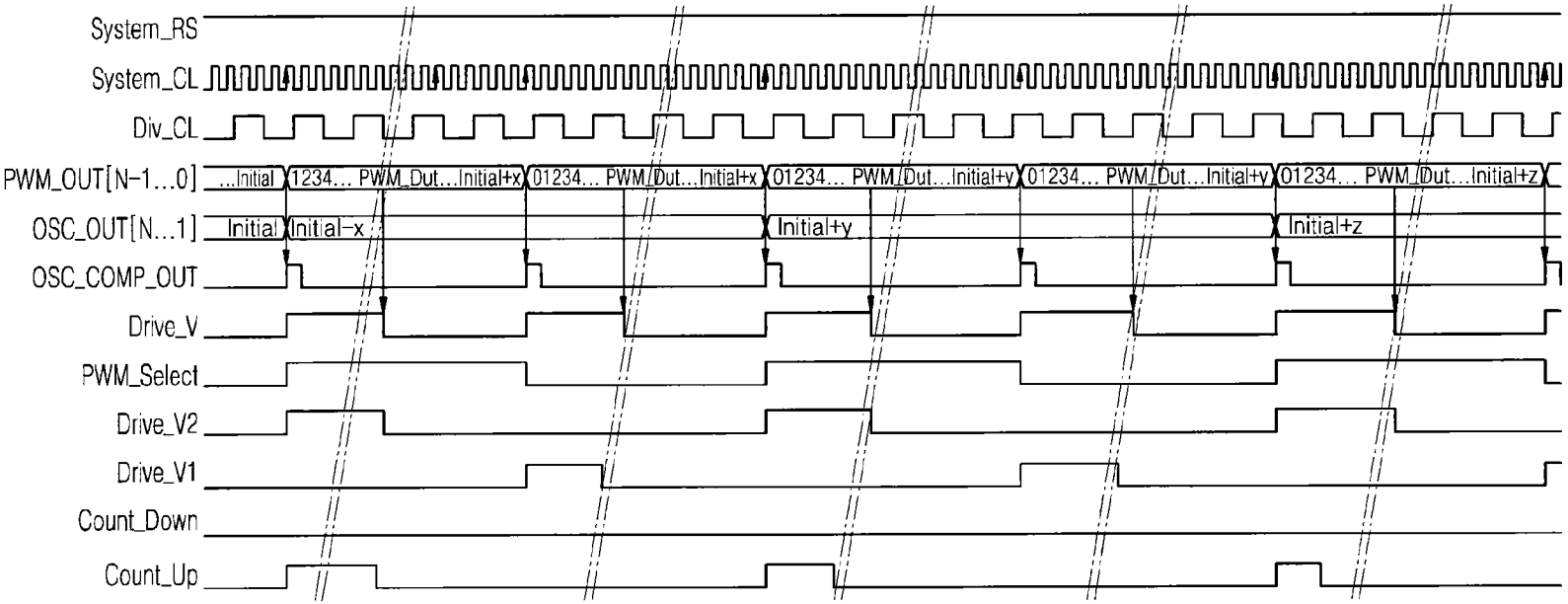
FIG. 13 is a timing chart showing output details of a resonance frequency tracking oscillator and a PWM signal generator.

Next, operations of the resonance frequency tracking oscillating unit 126 and the PWM signal generator 127 will be described. FIGS. 11 to 13 are timing chart diagrams showing details of outputs of the resonance frequency tracking oscillator 126 and the PWM signal generator 127

FIG. 11 is a timing chart when the power of the induction heating fusing device 100 is turned on and then the induction heating fusing device is oscillated at an initial set frequency (=resonance frequency), FIG. 12 is a timing chart when the resonance frequency is higher than the initial set frequency, and FIG. 13 is a timing chart when the resonance frequency is lower than the initial set frequency.

First, when the power of the induction heating fusing device is turned on and then the induction heating fusing device is oscillated at an initial set frequency (=resonance frequency), operations of the resonance frequency tracking oscillator 126 and the PWM signal generator 127 will be described with reference to FIG. 11. When a value of the output PWM_OUT [N−1 . . . ] of the PWM counter 144 becomes f_initial, a value corresponding to the initial set frequency, the output of the PWM counter 144 is reset, the output of the OSC comparator 145 is converted from Low to High, and the output Drive_V1 of the DFF 156 is converted from Low to High. The drive voltages Drive_V1 and Drive_V2 synchronized by a combination of the output of the DFF 156 and the output of the 1 bit counter 146 are outputted from the AND gates 157 and 158, respectively.

Next, when the resonance frequency is higher than the initial set frequency, operations of the resonance frequency tracking oscillator 126 and the PWM signal generator 127 will be described with reference to FIG. 12. If the resonance frequency is higher than the initial set frequency, Count_Down among the outputs of the phase comparator 125 becomes High. By doing so, the period during which the output OSC_COMP_OUT of the OSC comparator 145 is converted from Low to High is shortened (i.e., Initial→Initial-x→Initial-y→Initial-z), and the period during which the output Drive_V of the DFF 156 is converted from Low to High varies. By doing so, it becomes possible to track the operating frequency of the drive voltage to the resonance frequency.

Lastly, when the resonance frequency is lower than the initial set frequency, operations of the resonance frequency tracking oscillator 126 and the PWM signal generator 127 will be described with reference to FIG. 13. If the resonance frequency is lower than the initial set frequency, Count_Up among the outputs of the phase comparator 125 becomes High. By doing so, the period during which the output OSC_COMP_OUT of the OSC comparator 145 is converted from Low to High is increased (i.e., Initial→Initial+x→Initial+y→Initial+z), and the period during which the output Drive_V of the DFF 156 is converted from Low to High varies. By doing so, it becomes possible to track the operating frequency of the drive voltage to the resonance frequency.

Thus, a control is performed by increasing or decreasing a value of the up/down counter from a detection result of a phase difference between the drive voltage and the coil current such that the operating frequency of the drive voltage becomes the resonance frequency, and the PWM duty controller 119 calculates a PWM Duty value from a PWM Duty correction value obtained by a PID operation of the PID controller 117.

When the output value of the PWM counter 144 coincides with the PWM Duty value, the drive voltage is made Low, and when he output value of the PWM counter 144 coincides with the value of the up/down counter 141, the drive voltage is made High to thus generate a resonance frequency PWM signal Drive_V. Half bridge drive signals, i.e., Drive_V1 and Drive V2 are alternately outputted by inputting an output allowance signal every half a period generated by the 1 bit counter 146 and the resonance frequency PWM signal generated by the DFF 156 into the AND gates 157 and 158.

According to the induction heating fusing device 100 of the present disclosure, the PWM control may be performed in a resonance state automatically tracking the resonance frequency $f_0$ to control the amount of current and thus change the amount of electric power. As a result, the electric power efficiency of the induction heating fusing device 100 may be improved.

Modified Example

Figure 14:
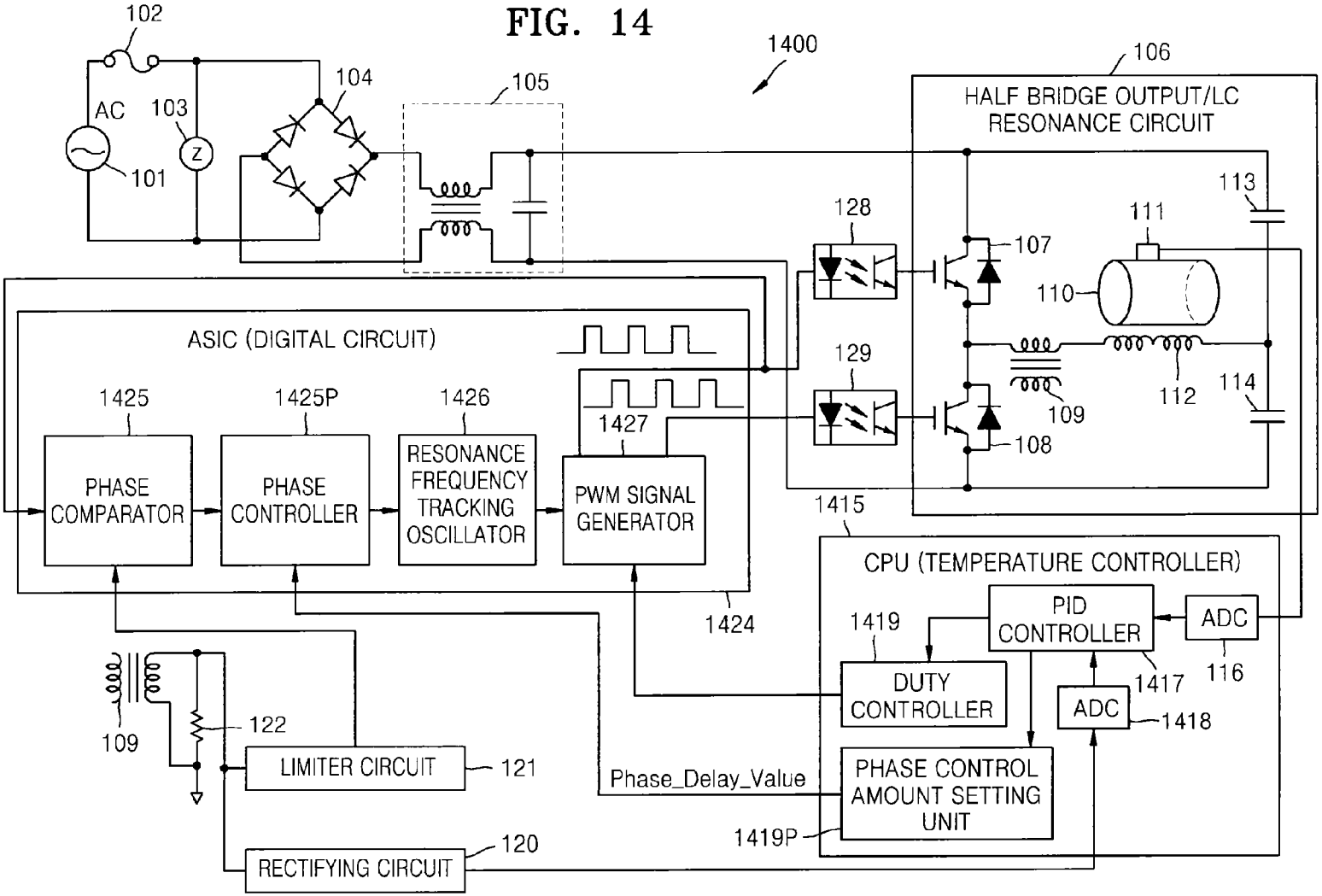
FIG. 14 is a circuit diagram showing a construction of an induction heating fusing device according to an exemplary embodiment of the present disclosure.
Figure 15:
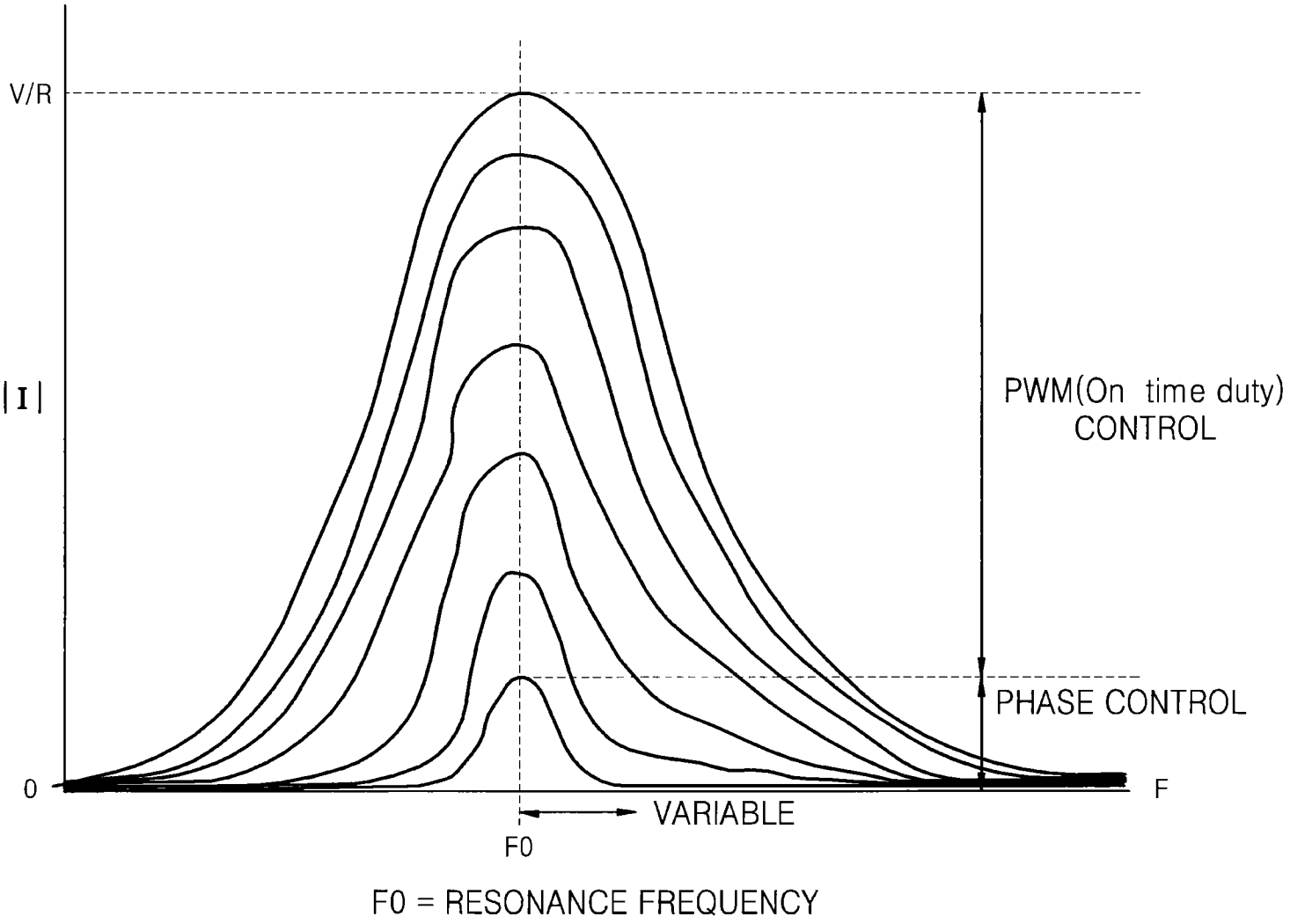
FIG. 15 is a graph showing an output characteristic when On time duty of PWM is changed.

FIG. 14 is a circuit diagram for explaining an operation of an induction heating fusing device 1400. FIG. 15 is a graph showing an output characteristic when On time duty of PWM is changed for explaining an operation of an induction heating fusing device 1400.

The induction heating fusing device 1400 is provided with an ASIC 1424. The ASIC 1424 is different from the ASIC 124 of FIG. 2 in that the ASIC 1424 is provided with a phase comparator 1425, a phase controller 1425P, a resonance frequency tracking oscillator 1426, and a PWM signal generator 1427. A CPU 1415 includes an ADC 1416, a PID controller 1417, an ADC 1418, a PWM duty controller 1419, and a phase control amount setting unit 1419P. The ADC 1416, the PID controller 1417, the ADC 1418, and the PWM duty controller 1419 of FIG. 14 correspond to the ADC 116, the PID controller 117, the ADC 118, and the PWM duty controller 119 of FIG. 2, respectively.

Figure 16:
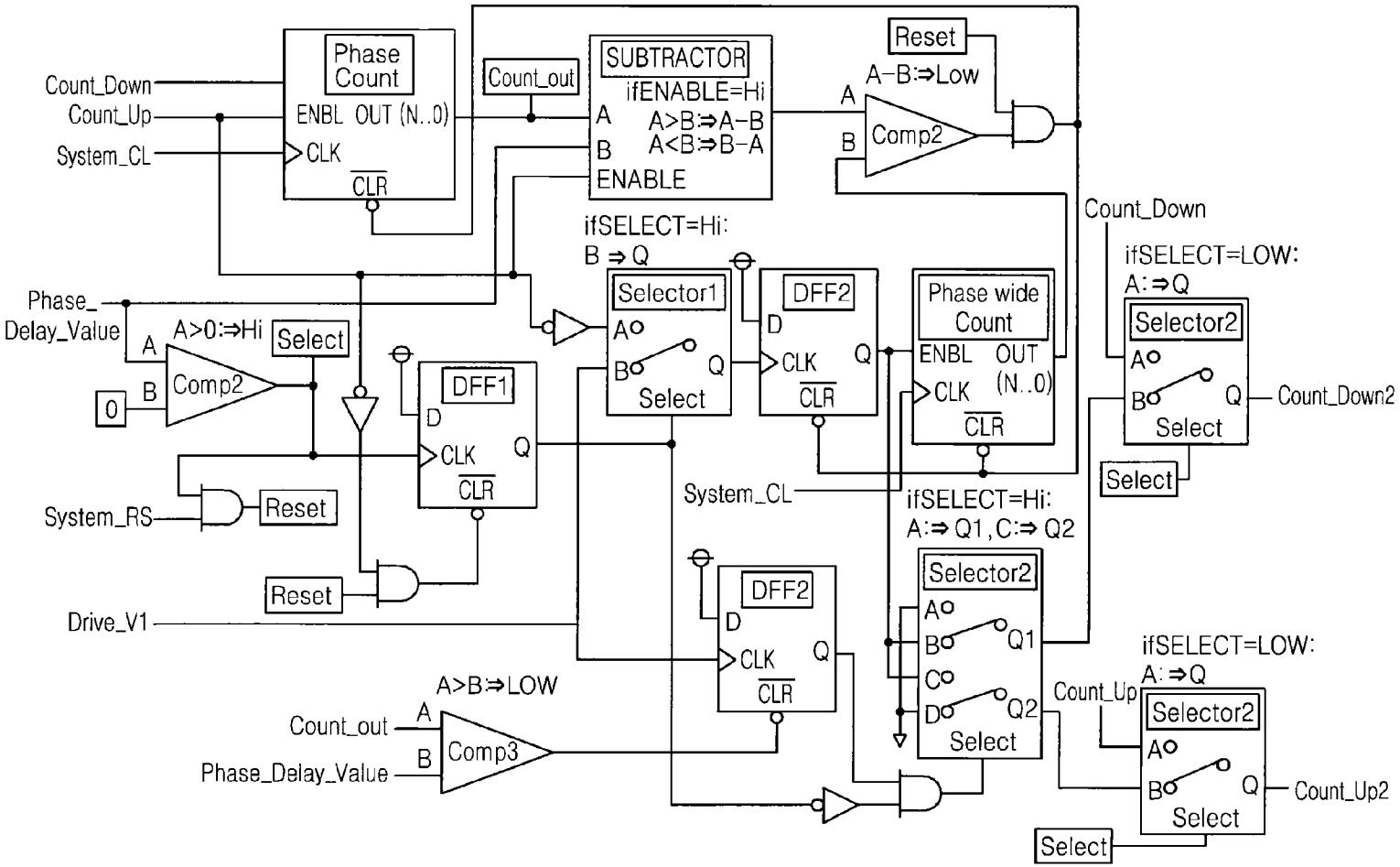
FIG. 16 is a circuit diagram showing a concrete construction of a phase controller.

FIG. 16 shows a concrete construction of the phase controller 1425P. When the set value of phase control amount of coil current Phase_Delay_Value is 0, a resonance frequency tracking control is performed as described with reference to FIG. 2, etc.

The phase comparator 1425, the resonance frequency tracking oscillator 1426, and the PWM signal generator 1427 of FIG. 14 correspond to the phase comparator 125, the resonance frequency tracking oscillator 126, and the PWM signal generator 127 of FIG. 2, respectively. The phase comparator 1425, the resonance frequency tracking oscillator 1426, and the PWM signal generator 1427 measure a phase difference between the drive voltage and the coil current, and perform a control automatically tracking the resonance frequency that the phase difference becomes 0. Specifically, the resonance frequency f0 is variable as shown in FIG. 15.

Figure 17:
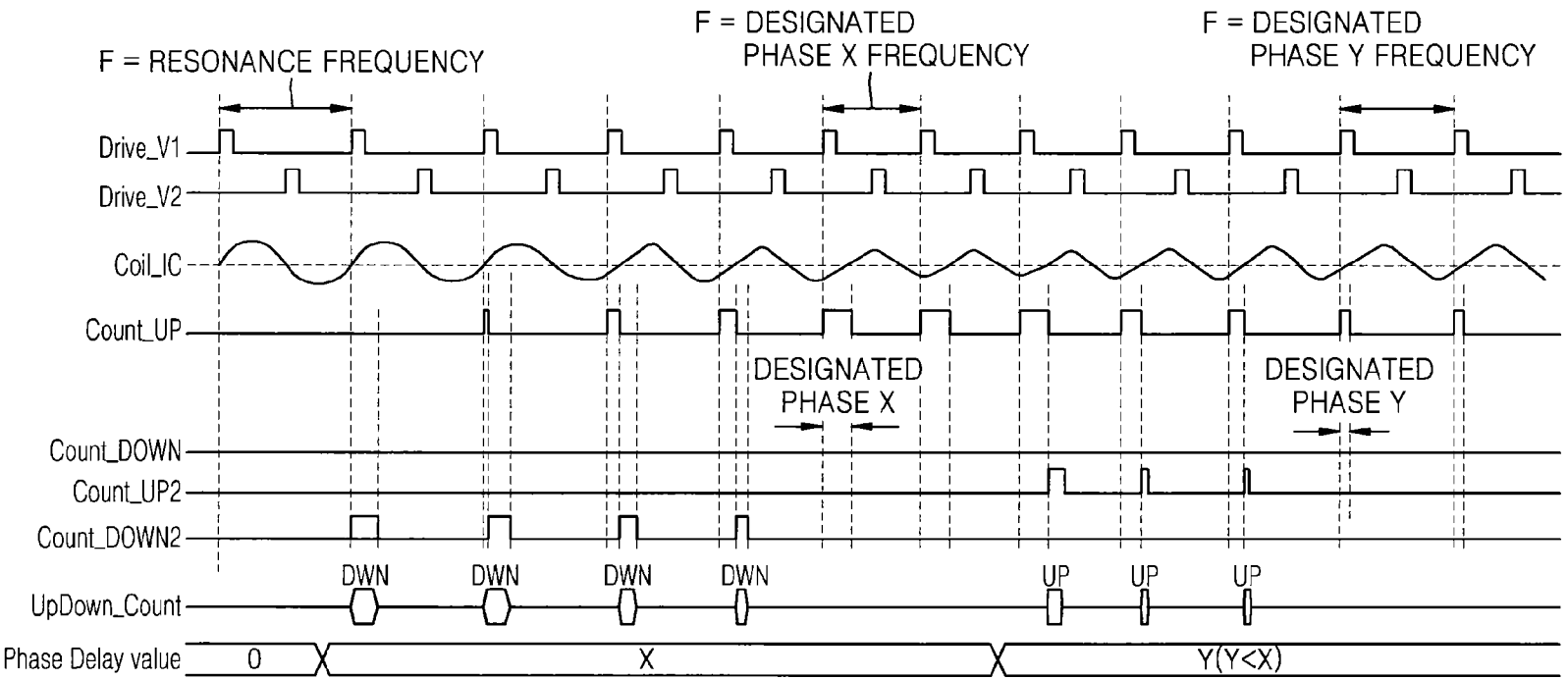
FIG. 17 is a diagram showing operation waveforms of a drive voltage, a coil current and a frequency control signal when the phase controller of FIG. 16 changes the set value of a phase control amount of coil current from 0 to Y via X.

FIG. 17 shows operation waveforms of drive voltages, coil current, and frequency control signals Count_Up, Count_Up2, Count_Down, and Count_Down2 when the phase controller 1425P of FIG. 16 converts the set value of phase control amount of coil current Phase_Delay_Value from 0 to Y via X (where X>Y).

In performing the resonance frequency control, the CPU 1415 of FIG. 14 sets the set value of phase control amount of coil current Phase_Delay_Value to 0. At this time, a Select signal outputted by Comp1 of FIG. 16 is made Low, and thus Selector2 and Selector3 select an input A. As a result, phase comparison output signals Count_Up and Count_Down are directly inputted into the resonance frequency tracking oscillator 1426 without passing through the phase controller 1425P. Therefore, the resonance frequency control is performed.

When the set value of phase control amount of coil current Phase_Delay_Value is converted from 0 (resonance state) to X, a frequency control signal Count_Down2 corresponding to the set value X is outputted, and as the frequency is elevated and approaches the set value of phase control amount X, the pulse width is decreased, and finally when the set value of phase control amount becomes X, the output of the frequency control signal Count_Down2 stops.

In concretely performing the phase control, the CPU 1415 of FIG. 14 sets the set value of phase control amount of coil current Phase_Delay_Value to a value of more than 0. When the set value of phase control amount of coil current Phase_Delay_Value is set to a value of more than 0, the Select signal that is an output of Comp1 of FIG. 16 is made High, and thus Selector2 and Selector3 select an input B. As a result, the phase comparison output signals Count_Up and Count_Down are inputted into the phase controller 1425P to perform a phase control, and signals Count_Up2 and Count_Down2 are inputted into the resonance frequency tracking oscillator 1426. Thus, the phase control is performed.

When the set value of phase control amount of coil current Phase_Delay_Value is converted from X to Y (where X>Y), a frequency control signal Count_Up2 that is proportional to a difference between X and Y is outputted, and as the frequency is elevated and approaches the set value of phase control amount Y, the pulse width is decreased, and finally when the set value of phase control amount becomes Y, the output of the frequency control signal Count_Up2 stops.

Figure 18:
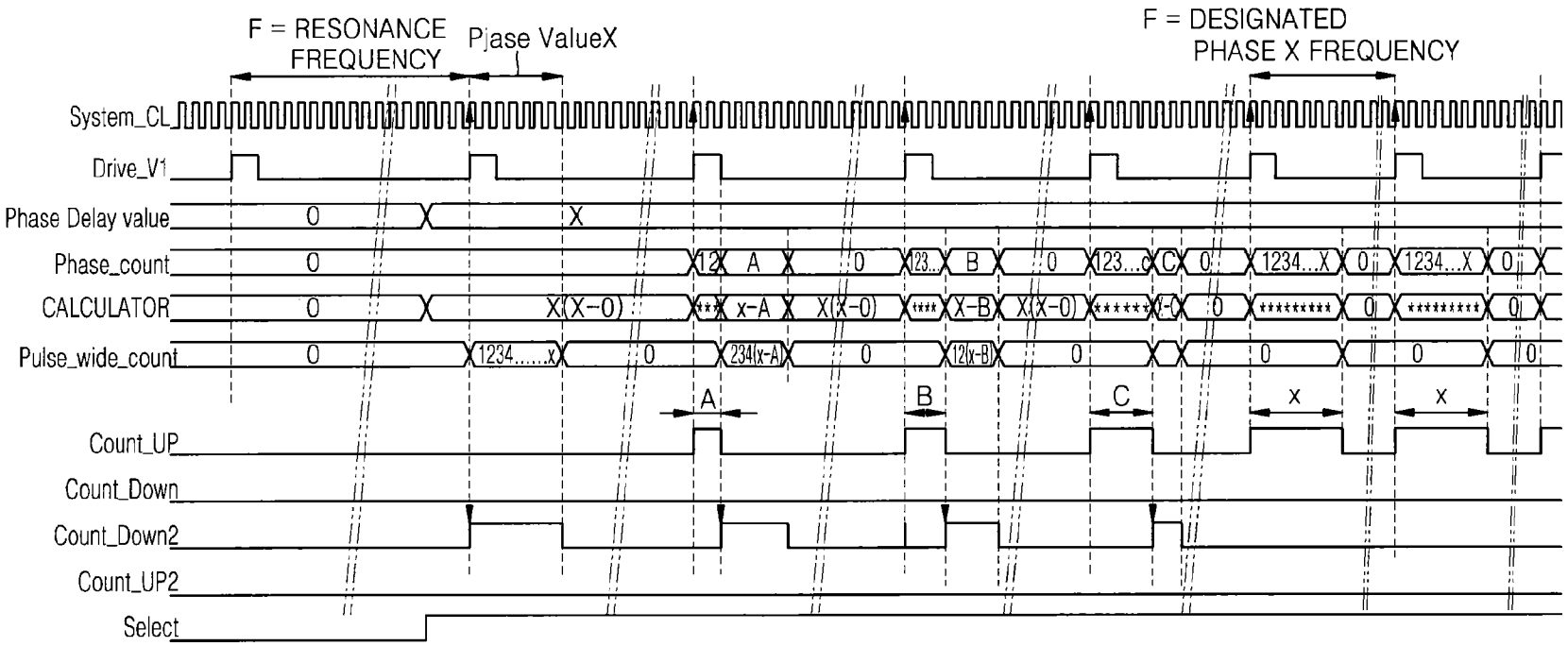
FIG. 18 is a timing diagram of a signal in the phase controller of FIG. 16.
Figure 19:
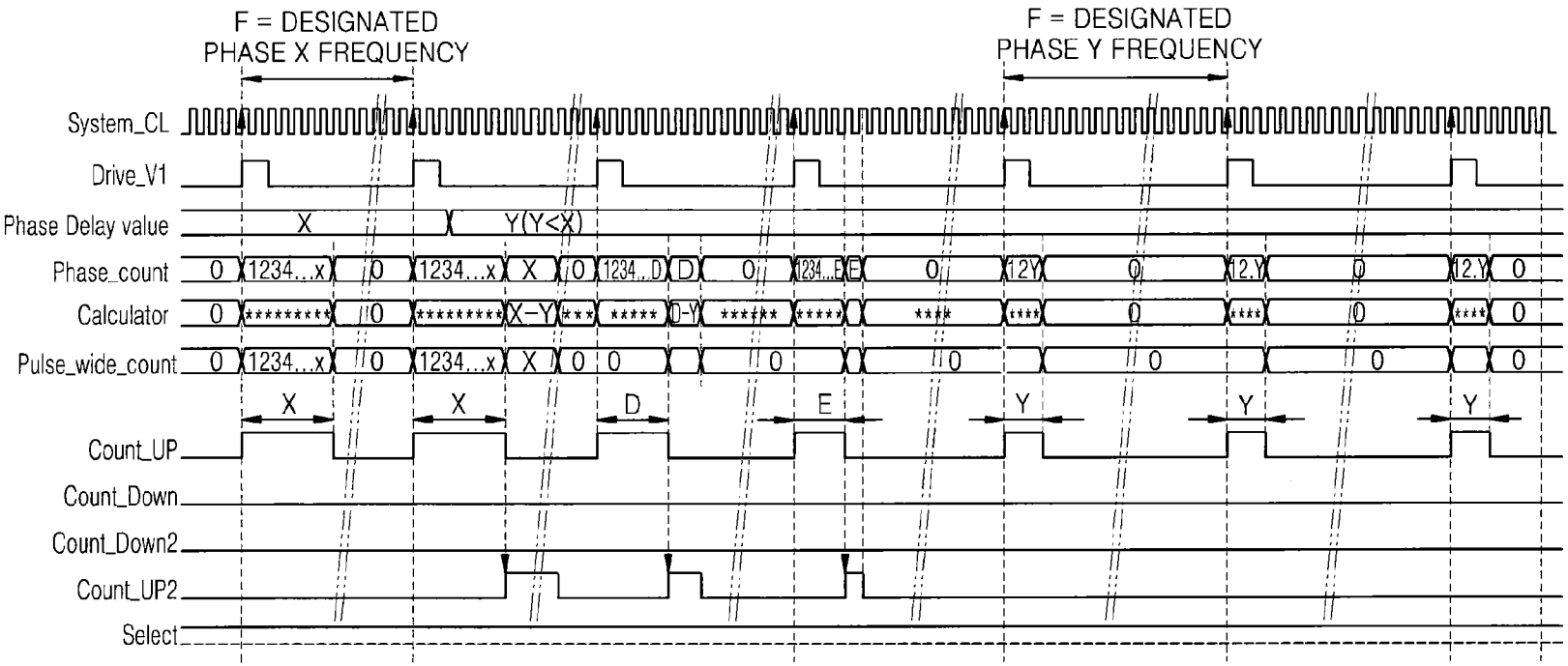
FIG. 19 is a timing diagram of a signal in the phase controller of FIG. 16.

FIGS. 18 and 19 are timing charts of signals in the phase controller 1425P of FIG. 16. FIG. 18 shows an operation timing when the set value of phase control amount of coil current Phase_Delay_Value is converted from 0 to X in FIG. 17. FIG. 19 shows an operation timing when the set value of phase control amount of coil current Phase_Delay_Value is converted from X to Y (where X>Y) in FIG. 17.

Action & Effect

The induction heating fusing device 100 of FIG. 2 controls a temperature by a PWM control. That is, the induction heating fusing device 100 controls power by calculating optimized PWM values over all current values shown in FIG. 4. In other words, the switching element is switched at a resonance frequency, and a pulse width thereof changes based on a signal from the temperature sensor.

Compared to this, the induction heating fusing device 1400 performs a PWM control when a current flowing through a coil is large and performs a phase control when a current flowing through a coil is small. Specifically, the ASIC 1424 includes the phase controller 1425. The phase controller 1425 performs the phase control on a coil current in a small current region.

The CPU 1415 having the function of a temperature controller may control power (that is, temperature) in two modes by calculating the optimized PWM value and the optimized value of the coil current phase based on a signal from the temperature sensor 111. In the small current region in which the current flowing through the coil is small, the phase controller 1425P performs the phase control based on a set value of phase control amount of coil current Phase_Delay_Value and thus controls the coil current. That is, on the basis of the tracked resonance frequency, the magnitude of a current is controlled according to the set value of phase control amount of coil current Phase_Delay_Value, and thus performs a temperature control. Resultantly, it is possible to control the temperature in a very small power region.

In a large current region in which a current flowing through the coil is large, a PWM control is performed in the same manner as in the induction heating fusing device 100 of FIG. 2. In this modification, such a configuration enables the coil current to be controlled even in the very small current region as illustrated in FIG. 15, thus making it possible to more minutely control the temperature.

In particular, since the coil current phase delay control circuit is configured with a simple logic circuit (digital circuit), the temperature can be stably controlled digitally without being affected by a variation in temperature or deviation in invariable. Since all of the control circuits are configured with digital circuits, they can be simply built in the ASIC to achieve cost reduction and minimization.

Further, in this modification, the phase control is performed only for controlling a very small current in the case of a small power, but the present disclosure is not limited thereto. For example, a power control can also be performed using the phase control even in a large current region and a middle current region.

CONCLUSION

Since the inductively heating fusing device according to various embodiments of the present disclosure may simply achieve digital circuits of a resonance frequency tracking oscillator and a PWM signal generator by using an up/down counter and a PWM counter, the resonance frequency tracking oscillator and a PWM signal generator can be built in the ASIC 124.

Therefore, the inductively heating fusing device according to the embodiments of the present disclosure can reduce hardware parts in comparison with the related art inductively heating fusing device, thereby reducing cost and improving assembling efficiency. Also, the inductively heating fusing device 1400 according to the certain embodiment of the present disclosure does not need to consider a deviation in component constant or variation in temperature by including digital circuits, and is also compatible with any specification without a change in hardware by modifying set values with software. This provides a significant effect when compared to the related art induction heating fusing device consisting of analog circuits, in which the invariable of part or variation in temperature should be considered, or the component constant should be changed by the specification, for example, setting of the tracking range of the resonance frequency.

Furthermore, the induction heating fusing device according to the certain embodiment of the present disclosure is controlled with the digital circuit. Therefore, if there is any specific unavailable frequency band (a specific wireless frequency or resonance frequency of a fusing device such as a fusing belt), the control may be easily performed by setting that frequency band.

According to the present disclosure, novel and improved induction heating fusing device and image forming apparatus that may perform a PWM control and a phase control tracking a resonance frequency without considering a deviation of a part constant or a temperature variation may be provided.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

INDUSTRIAL APPLICABILITY

The present disclosure is industrially applicable in that it provides an induction heating fusing device and an image forming apparatuses that may control even a very small current region by tracking a resonance frequency to perform a PWM control and phase control without considering a deviation of a part constant or a temperature change.

What is claimed is:

1. An induction heating fusing device comprising:

a serial resonance circuit having an induction coil and a condenser;

a phase comparator, a phase controller, a resonance frequency tracking oscillator, and a PWM (pulse width modulation) signal generator, wherein the phase comparator compares a phase of a pulse outputted by the PWM signal generator with a phase of current flowing through the induction coil, outputs a comparison result obtained by the comparing to the phase controller when controlling the phase, and outputs the comparison result to the resonance frequency tracking oscillator when performing PWM control, the phase controller outputs a frequency control signal which has a predetermined phase value based on an output of the phase comparator and a predetermined coil current phase amount, the resonance frequency tracking oscillator changes an oscillation frequency by using an output of the phase controller such that a driving frequency of the serial resonance circuit tracks the resonance frequency, the PWM signal generator generating a pulse to drive the serial resonance circuit based on the resonance frequency by the resonance frequency tracking oscillator, and the phase comparator, the phase controller, the resonance frequency tracking oscillator, and the PWM signal generator are digitally controlled.

2. The induction heating fusing device of claim 1, wherein the phase controller counts at a counter thereof an output of the phase comparator which compares the phase of the pulse outputted by the PWM signal generator with the phase of current flowing through the induction coil to output a signal corresponding to the phase difference, compares and operates a set value of phase amount of coil current by using a subtractor, and outputs a frequency control signal to the resonance frequency tracking oscillator, and the resonance frequency tracking oscillator moves up or down the counter based on a signal outputted by the phase controller to change the oscillation frequency.

3. The induction heating fusing device of claim 1, wherein the phase control is performed in a first region through which a relatively small current flows, and the PWM control is performed in a second region through which a relatively large current flows.

4. An image forming apparatus comprising the induction heating fusing device of claim 1.

5. An induction heating fusing device for an image forming apparatus having a fusing roller or a fusing belt, comprising:

an alternating current (AC) power supply;

a diode bridge;

a noise filter;

a half bridge output circuit, an AC current from the AC power supply being full-wave rectified, passing through the noise filter, and being supplied to the half bridge output circuit, the half bridge output circuit including IBGTs, an induction heating low loss coil and condensers, the induction heating low loss coil and the condensers constituting an LC resonance circuit;

a central processing unit (CPU) to measure a temperature of the fusing roller or fusing belt;

a current transformer;

a limiter circuit to limit the output voltage of the current transformer to within a predetermined range; and a rectifying circuit to rectify an output of the current transformer; and an application specific integrated circuit (ASIC) including a phase comparator to detect a phase difference, a resonance frequency tracking oscillator and a PWM signal generator, wherein the CPU controls a duty of a PWM signal generated by the PWM signal generator based on the temperature of the fusing roller or the fusing belt.

6. The induction heating fusing device of claim 5, wherein the phase comparator is configured to detect the phase difference between one of two PWM signals generated by the PWM signal generator and a current outputted from the limiter circuit.

7. The induction heating fusing device of claim 6, wherein the resonance frequency tracking oscillator is configured to track an oscillation frequency of the PWM signal generated by the PWM signal generator to the resonance frequency of the LC resonance circuit by using the phase difference detection result.

8. The induction heating fusing device of claim 7, wherein the PWM signal generator is configured to generate a PWM signal by using an oscillation frequency varying based on the result of tracking the oscillation frequency to the resonance frequency of the LC resonance circuit.

9. The induction heating fusing device of claim 5, wherein the limiter circuit outputs the limited output voltage to the phase comparator.

10. An induction heating fusing device, comprising:

a serial resonance circuit including an induction coil and a condenser; and an application specific integrated circuit (ASIC) comprising a phase comparator, a phase controller, a resonance frequency tracking oscillator, and a PWM signal generator, wherein the phase comparator is configured to compare a phase of a pulse outputted by the PWM signal generator with a phase of current flowing through the induction coil, such that the phase comparator outputs a comparison result of the comparing to the phase controller when controlling the phase, and outputs the comparison result to the resonance frequency tracking oscillator when performing PWM control.

* * * * *